US010946351B2

(12) United States Patent
Masuda et al.

(10) Patent No.: US 10,946,351 B2
(45) Date of Patent: Mar. 16, 2021

(54) PADDLE, PLATING APPARATUS EQUIPPED WITH THE PADDLE, AND PLATING METHOD

(71) Applicant: EBARA CORPORATION, Tokyo (JP)

(72) Inventors: Yasuyuki Masuda, Tokyo (JP); Masashi Shimoyama, Tokyo (JP); Jumpei Fujikata, Tokyo (JP); Yohei Wakuda, Tokyo (JP); Shao Hua Chang, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 119 days.

(21) Appl. No.: 15/887,430

(22) Filed: Feb. 2, 2018

(65) Prior Publication Data

US 2018/0221835 A1 Aug. 9, 2018

(30) Foreign Application Priority Data

Feb. 6, 2017 (JP) ..... JP2017-019507

(51) Int. Cl.

| | |
|---|---|
| ***B01F 11/00*** | (2006.01) |
| ***C25D 17/00*** | (2006.01) |
| ***C25D 21/10*** | (2006.01) |
| ***C25D 17/06*** | (2006.01) |
| ***C25D 17/02*** | (2006.01) |
| ***C25D 21/18*** | (2006.01) |
| *C25D 21/12* | (2006.01) |

(52) U.S. Cl.

CPC ..... *B01F 11/0082* (2013.01); *B01F 11/0097* (2013.01); *C25D 17/001* (2013.01); *C25D 17/02* (2013.01); *C25D 17/06* (2013.01); *C25D 21/10* (2013.01); *C25D 21/18* (2013.01); *B01F 2215/0096* (2013.01); *C25D 21/12* (2013.01)

(58) Field of Classification Search

CPC ..... B01F 11/0082; B01F 11/0097; B01F 2215/0096; C25D 17/001

See application file for complete search history.

(56) References Cited

U.S. PATENT DOCUMENTS

| | | | | |
|---|---|---|---|---|
| 7,390,383 | B2 * | 6/2008 | McHugh | C25D 17/008 204/273 |
| 2004/0217007 | A1 * | 11/2004 | Diel | C25D 21/18 205/101 |
| 2006/0081478 | A1 * | 4/2006 | Sahoda | C25D 5/08 205/148 |

FOREIGN PATENT DOCUMENTS

| | | | |
|---|---|---|---|
| CN | 1960799 | A | 5/2007 |
| CN | 102641677 | A | 8/2012 |
| CN | 202558955 | U | 11/2012 |
| CN | 205603714 | U | 9/2016 |
| JP | 2005-008911 | A | 1/2005 |
| JP | 2007-046154 | A | 2/2007 |

* cited by examiner

*Primary Examiner* — Anshu Bhatia
(74) *Attorney, Agent, or Firm* — BakerHostetler

(57) ABSTRACT

A paddle for agitating a plating solution by reciprocating parallel to a surface of a substrate is disclosed. The paddle includes a plurality of vertically-extending agitation rods. Each agitation rod includes: a planar portion perpendicular to a reciprocating direction of the paddle; two slope surfaces extending from side ends of the planar portion in directions closer to each other, the two slope surfaces being symmetric with respect to a center line of the agitation rod, the center line being perpendicular to the planar portion; and a tip portion connected with the two slope surfaces.

7 Claims, 29 Drawing Sheets

FIG. 29

| Shape of Agitation Rod | Current Density [%] | | | |
|---|---|---|---|---|
| | 100 | 109 | 118 | 127 |
| Conventional Shape | ○ | × | — | — |
| Shape of FIG. 28A | ○ | ○ | ○ | ○ |
| Shape of FIG. 8 | ○ | ○ | ○ | ○ |
| Shape of FIG. 28B | ○ | ○ | ○ | × |
| Shape of FIG. 28C | ○ | ○ | ○ | × |
| Shape of FIG. 18 | ○ | ○ | ○ | × |
| Shape of FIG. 24 | ○ | ○ | × | — |

—: Shapeless ○: Normal ×: Abnormal Appearance

*FIG. 30A*

| R1/a2 | Current Density [%] | | |
|---|---|---|---|
| | 100.0% | 112.5% | 125.0% |
| 0.667 | ○ | × | — |
| 0.833 | ○ | × | × |
| 1.000 | ○ | × | × |

*FIG. 30B*

| R1/a2 | Paddle Speed [%] | | |
|---|---|---|---|
| | 100.0% | 80.0% | 66.7% |
| 0.667 | ○ | × | — |
| 0.833 | ○ | ○ | × |
| 1.000 | ○ | ○ | ○ |

*FIG. 31A*

| b1/a1 | Current Density [%] | | |
|---|---|---|---|
| | 100.0% | 112.5% | 125.0% |
| 0.500 | ○ | ○ | × |
| 0.667 | ○ | × | — |
| 0.833 | × | — | — |

*FIG. 31B*

| b1/a1 | Paddle Speed [%] | | |
|---|---|---|---|
| | 100.0% | 80.0% | 66.7% |
| 0.667 | ○ | ○ | × |
| 0.500 | ○ | ○ | × |

PADDLE, PLATING APPARATUS EQUIPPED WITH THE PADDLE, AND PLATING METHOD

CROSS REFERENCE TO RELATED APPLICATION

This document claims priority to Japanese Patent Application No. 2017-019507 filed Feb. 6, 2017, the entire contents of which are hereby incorporated by reference.

BACKGROUND

FIG. 32 is a schematic view of a plating apparatus. As shown in FIG. 32, the plating apparatus includes a plating tank 201 for holding a plating solution therein, an anode 202 disposed in the plating tank 201, an anode holder 203 holding the anode 202, and a substrate holder 204. The substrate holder 204 is configured to detachably hold a substrate W, such as a wafer, and immerse the substrate W in the plating solution held in the plating tank 201. The anode 202 and the substrate W are each disposed in a vertical position and are disposed opposite each other in the plating solution.

The plating apparatus further includes a paddle 205 for agitating the plating solution in the plating tank 201, and a regulation plate 206 for regulating the distribution of electric potential on the substrate W. The regulation plate 206 is disposed between the paddle 205 and the anode 202, and has an opening 206*a* for restricting the electric field in the plating solution. The paddle 205 is disposed in the vicinity of the surface of the substrate W held by the substrate holder 204. The paddle 205 is disposed in a vertical position, and reciprocates parallel to the surface of the substrate W to agitate the plating solution so that a sufficient amount of metal ions can be supplied uniformly to the surface of the substrate W during plating of the substrate W.

The anode 202 is connected to a positive pole of a power source 207 via the anode holder 203, while the substrate W is connected to a negative pole of the power source 207 via the substrate holder 204. When a voltage is applied between the anode 202 and the substrate W, an electric current flows to the substrate W, and a metal film is formed on the surface of the substrate W.

FIG. 33 is a diagram showing the paddle 205 and the substrate W of FIG. 32, as viewed from the direction of line A. The depiction of the substrate holder 204 has been omitted from FIG. 33. The paddle 205 includes a plurality of vertically-extending agitation rods 208. The paddle 205 is disposed in the electric field formed between the anode 202 and the substrate W, and the agitation rods 208 reciprocate horizontally as shown by the arrows while blocking the electric field.

In order to plate a substrate W at a higher plating rate or to successfully perform plating of a substrate W having a trench structure or via structure, or a bump pattern of holes with a high aspect ratio (depth/diameter ratio), it is necessary to increase the supply of metal ions in the plating solution to the substrate W Therefore, there is a demand to increase the plating-solution agitating power of the paddle 205 in order to increase the supply of metal ions.

However, increasing the reciprocating speed of the paddle 205 for increasing the plating-solution agitating power can cause scattering of the plating solution in the plating tank 201, or may increase a load on a driving device that drives the paddle 205.

SUMMARY OF THE INVENTION

According to an embodiment, there is provided a paddle which, without an increase in the reciprocating speed, can generate an increased plating-solution agitating power. According to embodiments, there are provided a plating apparatus equipped with the paddle, and a plating method using the paddle.

Embodiments, which will be described below, relate to a paddle for use in plating of a surface of a substrate such as a water, a plating apparatus equipped with the paddle, and a plating method.

In one embodiment, there is provided a paddle for agitating a plating solution by reciprocating parallel to a surface of a substrate, comprising: a plurality of vertically-extending agitation rods, wherein each of the agitation rods includes: a planar portion perpendicular to a reciprocating direction of the paddle; two slope surfaces extending from side ends of the planar portion in directions closer to each other, the two slope surfaces being symmetric with respect to a center line of the agitation rod, the center line being perpendicular to the planar portion; and a tip portion connected with the two slope surfaces.

In one embodiment, the agitation rods face in the same direction.

In one embodiment, the agitation rods comprise first agitation rods facing in the same one direction and second agitation rods facing in the opposite direction.

In one embodiment, the first agitation rods are disposed at one side of a center line of the paddle; the second agitation rods are disposed at the opposite side of the center line of the paddle; and the first agitation rods and the second agitation rods face toward an outer side of the paddle.

In one embodiment, the first agitation rods are disposed at one side of a center line of the paddle; the second agitation rods are disposed at the opposite side of the center line of the paddle; and the first agitation rods and the second agitation rods face toward the center line of the paddle.

In one embodiment, the first agitation rods and the second agitation rods are arranged alternately.

In one embodiment, there is provided a paddle for agitating a plating solution by reciprocating parallel to a surface of a substrate, comprising: a plurality of vertically-extending agitation rods, wherein each of the agitation rods includes: a planar portion perpendicular to a reciprocating direction of the paddle; two slope surfaces extending from side ends of the planar portion in directions closer to each other; and a tip portion connected with the two slope surfaces, wherein the agitation rods comprise first agitation rods and second agitation rods which face in opposite directions and are arranged alternately, and wherein a distance between planar portions of a first agitation rod and an adjacent second agitation rod, facing away from each other, of the agitation rods is larger than a distance between tip portions of a first agitation rod and an adjacent second agitation rod, facing each other, of the agitation rods.

In one embodiment, a volume of a first flow passage formed between the first agitation rod and the adjacent second agitation rod facing away from each other is equal to a volume of a second flow passage formed between the first agitation rod and the adjacent second agitation rod facing each other.

In one embodiment, there is provided a plating apparatus comprising: a plating tank for holding a plating solution; an anode disposed in the plating tank; a substrate holder for holding a substrate and disposing the substrate in the plating tank; and the above-described paddle disposed between the anode and the substrate for agitating the plating solution by reciprocating parallel to a surface of the substrate.

In one embodiment, there is provided a plating method comprising: disposing an anode and a substrate opposite each other in a plating solution held in a plating tank; and reciprocating the above-described paddle, disposed between the anode and the substrate, parallel to the substrate while applying a voltage between the anode and the substrate.

According to the above-described embodiments, the plating-solution agitating power of the paddle can be increased without increasing the reciprocating speed of the paddle. Therefore, the use of the paddle in plating of a substrate can increase the supply of metal ions in a plating solution to the substrate.

BRIEF DESCRIPTION OF THE DRAWINGS

FIG. 29 is a diagram showing results of an experiment which was conducted to determine the agitating performances of the agitation rods according to the above-described embodiments;

FIGS. 30A and 30B are diagrams showing results of an experiment which was conducted to determine the agitating performance of the agitation rod having the shape of FIG. 28A for which good results were obtained in the experiment of FIG. 29;

FIGS. 31A and 31B are diagrams showing results of an experiment which was conducted to determine the agitating performance of the agitation rod having the shape of FIG. 8 for which good results were obtained in the experiment of FIG. 29;

DESCRIPTION OF EMBODIMENTS

Figure 1:
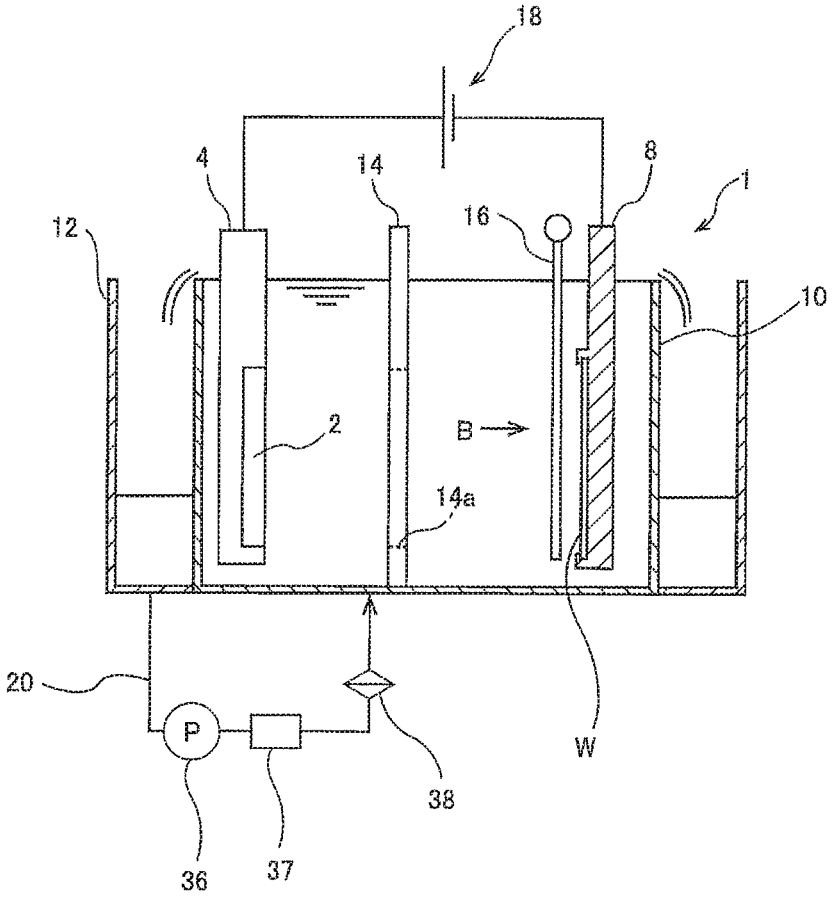
FIG. 1 is a schematic view of a plating apparatus according to an embodiment.

Embodiments will now be described with reference to the drawings. In the drawings described herein below, the same reference numerals are used to refer to the same or equivalent components or elements, and duplicate descriptions thereof are omitted.

FIG. 1 is a schematic view of a plating apparatus according to an embodiment. As shown in FIG. 1, the plating apparatus includes a plating tank 1 for holding a plating solution therein, an anode 2 disposed in the plating tank 1, an anode holder 4 holding the anode 2, and a substrate holder 8. The substrate holder 8 is configured to detachably hold a substrate W, such as a wafer, and immerse the substrate W in the plating solution held in the plating tank 1. The plating apparatus of this embodiment is an electroplating apparatus which plates a surface of the substrate W with a metal by passing an eclectic current through the plating solution.

The substrate W may be, for example, a semiconductor substrate, a glass substrate or a resin substrate. The metal to be plated onto the surface of the substrate W may be, for example, copper (Cu), nickel (Ni), tin (Sn), an Sn—Ag alloy or cobalt (Co).

The anode 2 and the substrate W are each disposed in a vertical position and are disposed opposite each other in the plating solution. The anode 2 is connected to a positive pole of a power source 18 via the anode holder 4, while the substrate W is connected to a negative pole of the power source 18 via the substrate holder 8. When a voltage is applied between the anode 2 and the substrate W, an electric current flows to the substrate W, and a metal film is formed on the surface of the substrate W.

The plating tank 1 includes a plating-solution reservoir 10 in which the substrate W and the anode 2 are disposed, and an overflow tank 12 located next to the plating-solution reservoir 10. The plating solution in the plating-solution reservoir 10 is allowed to overflow the side wall of the plating-solution reservoir 10 and flow into the overflow tank 12.

One end of a plating-solution circulation line 20 is connected to the bottom of the overflow tank 12, and the other end of the plating-solution circulation line 20 is connected to the bottom of the plating-solution reservoir 10. The plating-solution circulation line 20 is provided with a circulation pump 36, a constant-temperature unit 37 and a filter 38. The plating solution overflows the side wall of the plating-solution reservoir 10 and flows into the overflow tank 12, and is returned from the overflow tank 12 to the plating-solution reservoir 10 through the plating-solution circulation line 20. In this manner, the plating solution circulates between the plating-solution reservoir 10 and the overflow tank 12 through the plating-solution circulation line 20.

The plating apparatus further includes a regulation plate 14 for regulating the distribution of electric potential on the substrate W, and a paddle 16 for agitating the plating solution in the plating-solution reservoir 10. The regulation plate 14 is disposed between the paddle 16 and the anode 2, and has an opening Ha for restricting an electric field produced in the plating solution. The paddle 16 is disposed in the vicinity of the surface of the substrate W held by the substrate holder 8 in the plating-solution reservoir 10. A distance between the surface of the substrate W and the paddle 16 may be not more than 10 mm, or may be not more than 8 mm. The paddle 16 is made of, for example, titanium (Ti) or a resin. The paddle 16 is disposed in a vertical position, and reciprocates parallel to the surface of the substrate W to agitate the plating solution so that a sufficient amount of metal ions can be supplied uniformly to the surface of the substrate W during plating of the substrate W.

Figure 2A:
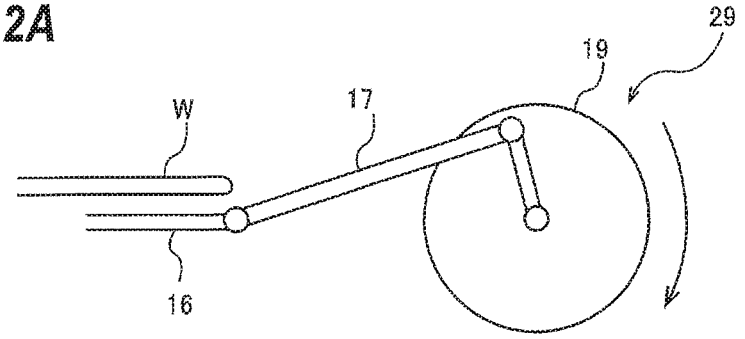
FIGS. 2A, 2B, 2C, 2D are schematic views of a paddle driving device for reciprocating a paddle.
Figure 2B:
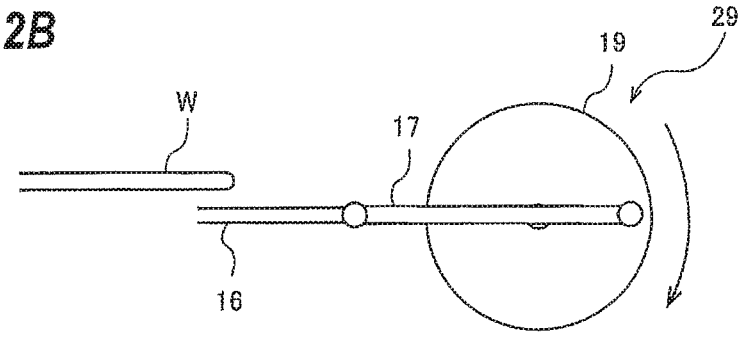
Figure 2C:
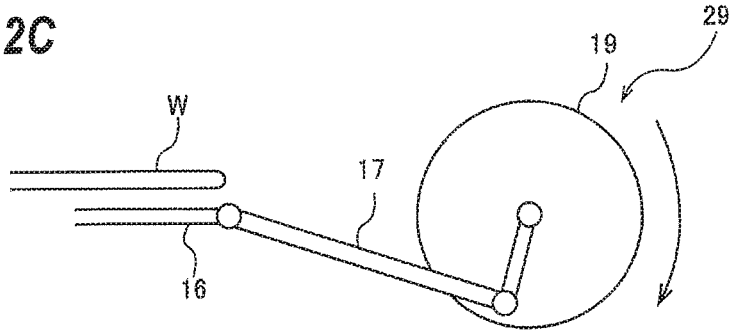
Figure 2D:
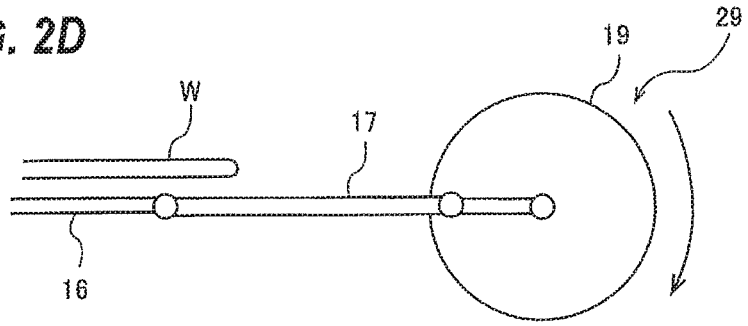
Figure 24:
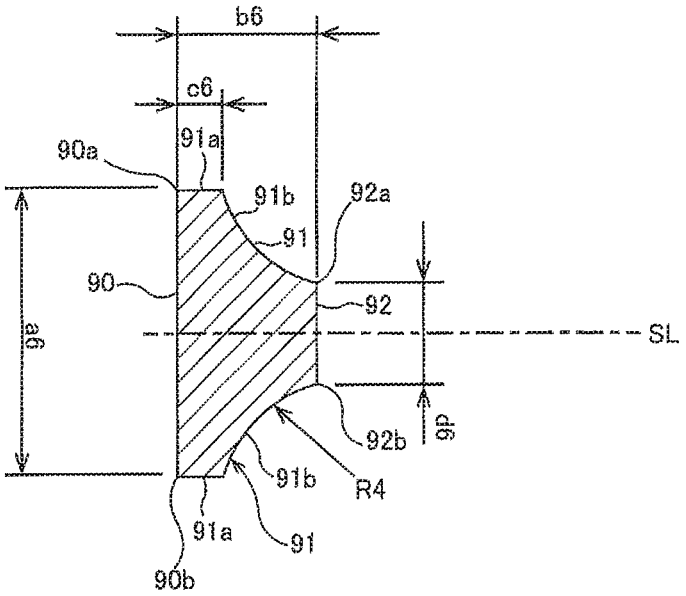
FIG. 24 is a diagram showing yet another embodiment of an agitation rod.

FIGS. 24 through 2D are schematic views of a paddle driving device 29 for reciprocating the paddle 16. The paddle 16 is coupled to a crank disk 19 via a connecting rod 17. The connecting rod 17 is eccentrically mounted to the crank disk 19. When the crank disk 19 rotates in a direction shown by an arrow, the paddle 16 reciprocates parallel to the substrate W. The paddle driving device 29 causes the paddle 16 to reciprocate parallel to the surface of the substrate W to thereby agitate the plating solution existing near the surface of the substrate W.

Figure 3:
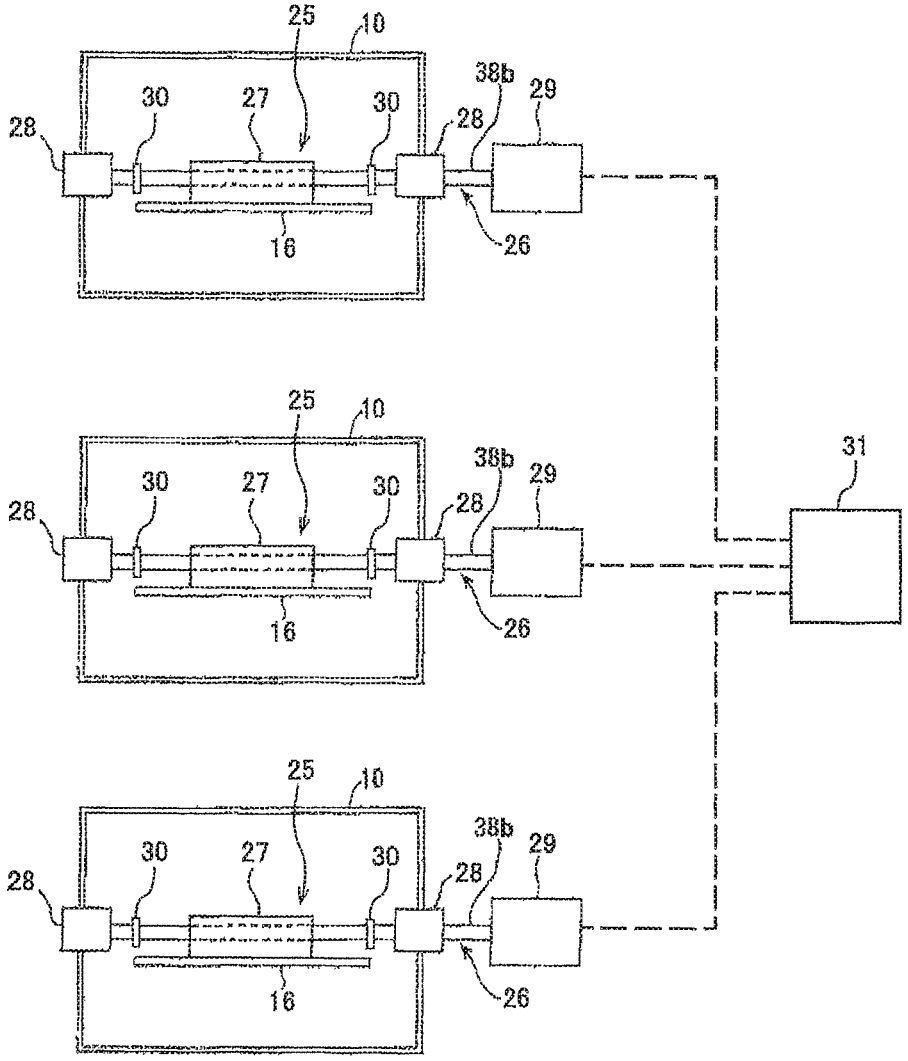
FIG. 3 is a diagram showing three adjacent plating-solution reservoirs and paddle units each for driving a paddle.

FIG. 3 is a diagram showing three adjacent plating-solution reservoirs 10 and paddle units 25 each for driving a paddle 16. Each paddle unit 25 includes the paddle 16, a horizontally-extending shaft 26, a paddle holder 27 supporting the paddle 16, a pair of shaft supports 28 supporting the shaft 26, and the above-described paddle driving device 29 for driving the paddle 16. The shaft 26 has flange portions 30 near both ends thereof. The flange portions 30 block the plating solution, which has adhered to the shaft 26, from moving on the shaft 26 and reaching the shaft supports 28. Rotation of a motor of the paddle driving device 29, i.e. the reciprocating movement of the paddle 16, is controlled by a paddle drive controller 31. The paddle drive controller 31 is connected to each of the paddle driving devices 29 so as to control the respective paddle driving devices 29.

If the reciprocating movements of the paddles 16 in the plating-solution reservoirs 10 synchronize, then it is possible that a large vibration may occur in the entire plating apparatus, in view of this, the paddle drive controller 31 controls the timing for starting up the motor of each paddle driving device 29 so that phases of the reciprocating movements of the paddles 16 do not synchronize, i.e. differ from each other. The paddle drive controller 31 may be configured to receive, from the motor of each paddle driving device 29, information on the operation of that motor and, based on data obtained from the motors, determine whether the phases of the reciprocating movements of the paddles 16 synchronize, and generate an instruction to the motor of each paddle driving device 29. Such control operation of the paddle drive controller 31 can prevent the occurrence of a large vibration of the entire plating apparatus. The paddle drive controller 31 may be programed to provide program instructions to a unified system including a single or a plurality of electroplating apparatuses.

Figure 4:
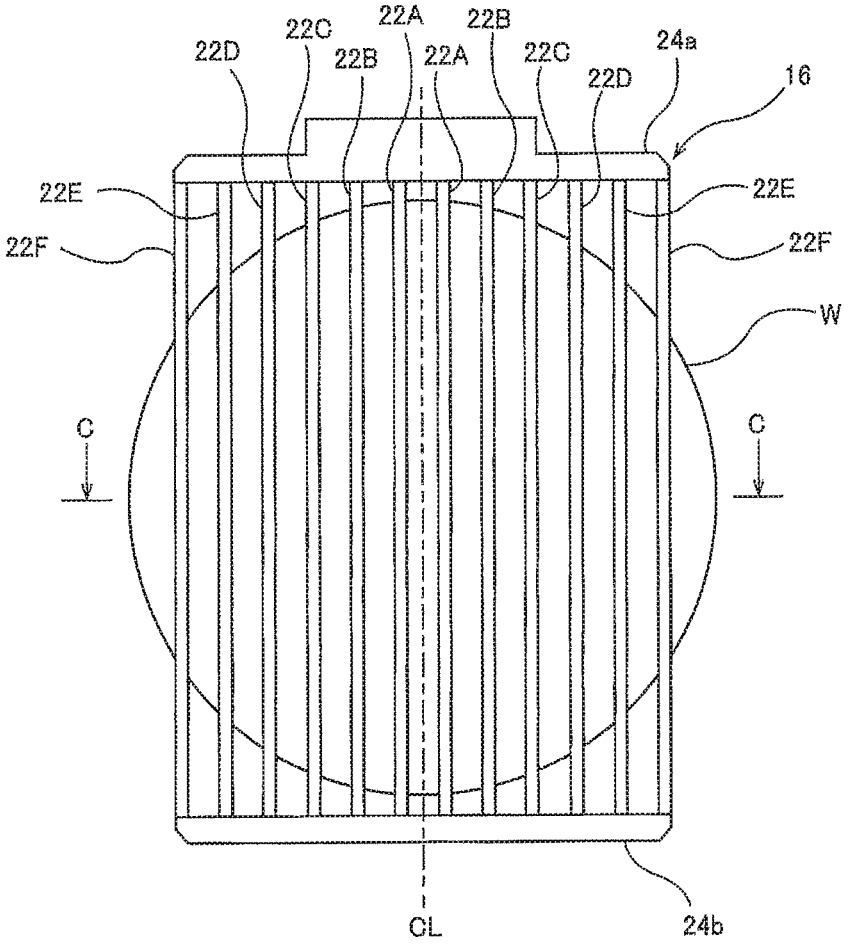
FIG. 4 is a diagram showing the paddle and the substrate of FIG. 1, as viewed from the direction of line B.
Figure 5:
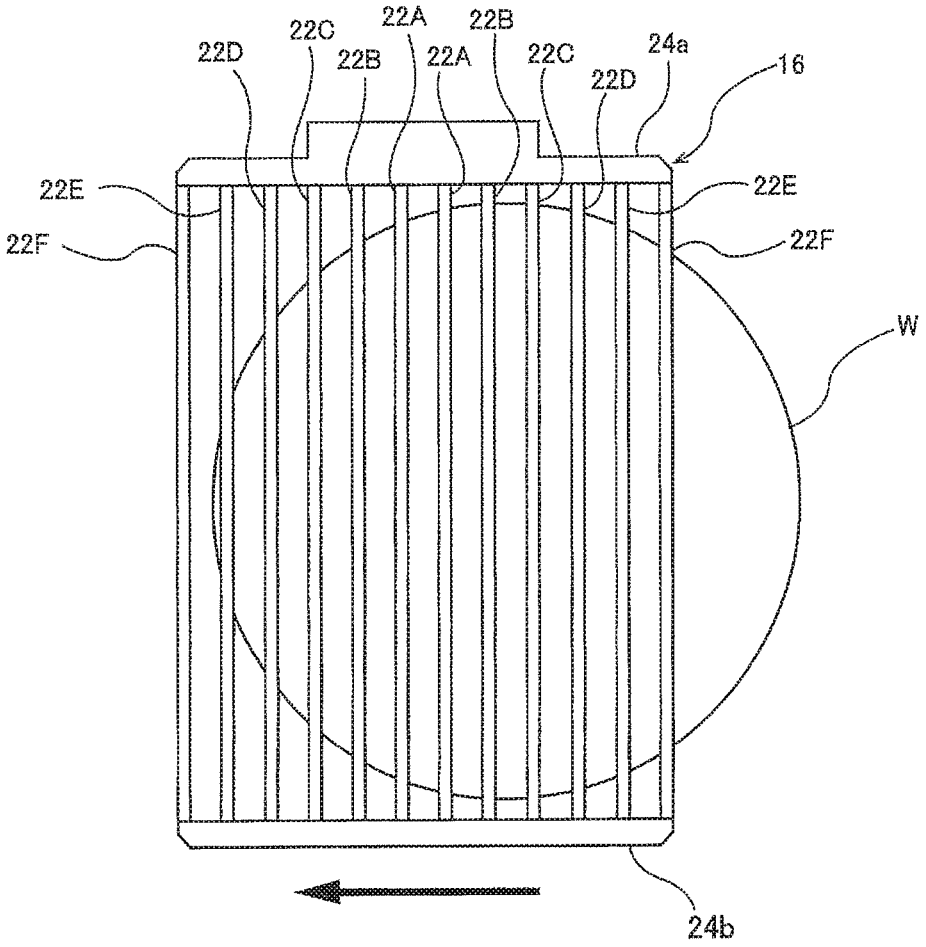
FIG. 5 is a diagram illustrating a reciprocating movement of the paddle.
Figure 6:
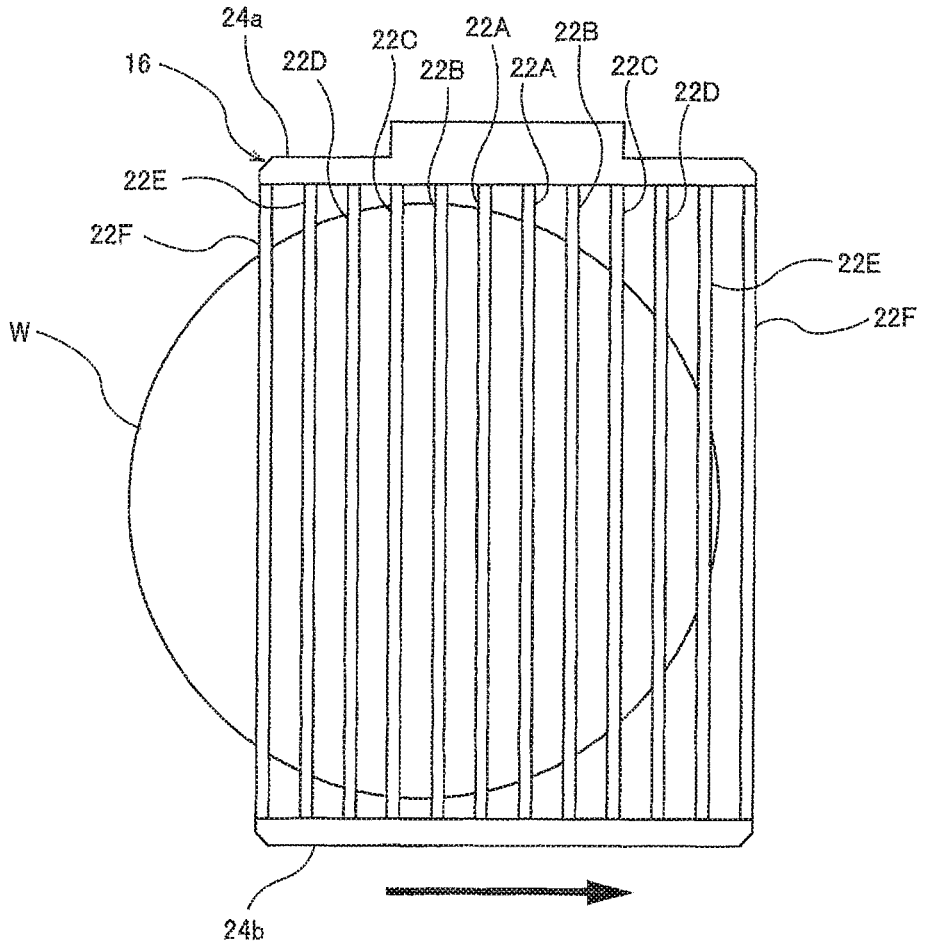
FIG. 6 is a diagram illustrating a reciprocating movement of the paddle.

FIG. 4 is a diagram showing the paddle 16 and the substrate W of FIG. 1, as viewed from the direction of line B. FIGS. 5 and 6 are diagrams each illustrating a reciprocating movement of the paddle 16. The depiction of the substrate holder 8 has been omitted from FIGS. 4 through 6. As shown in FIGS. 5 and 6, in the reciprocating movement of the paddle 16, the paddle 16 turns around after reaching the left side of the substrate W (see FIG. 5) and the right side of the substrate W (see FIG. 6). Such reciprocating movement of the paddle 16 agitates the plating solution existing near the surface of the substrate W.

The paddle 16 includes a plurality of vertically-extending agitation rods 22A to 22F, and holding members 24*a*, 24*b* holding the agitation rods 22A to 22F. The holding member 24*a* holds upper ends of the agitation rods 22A to 22F, and the holding member 24*b* holds lower ends of the agitation rods 22A to 22F. The holding members 24*a*, 24*b* extend horizontally and are disposed parallel to the surface of the substrate W. The holding members 24*a*, 24*b* may be hereinafter sometimes referred to collectively as holding members 24.

The agitation rods 22A to 22F are disposed parallel to each other and parallel to the surface of the substrate W. In this embodiment, no agitation rod is disposed on the center line CL of the paddle 16, and the agitation rods 22A to 22F are disposed at both sides of the center line CL. The center line CL of the paddle 16 is a line passing through the center of the paddle 16. In this embodiment the paddle 16 has twelve agitation rods, while the number of agitation rods is not limited to twelve. The agitation rods 22A to 22F may be hereinafter sometimes referred to collectively as agitation rods 22.

In this embodiment the diameter of the substrate W is 300 mm, and the width of the paddle 16 is smaller than the diameter of the substrate W. The diameter of the substrate W is not limited to this embodiment. While in this embodiment the substrate W has a circular shape, the substrate W may have a quadrangular shape. The vertical length of the agitation rods 22A to 22F may be equal to or longer than the diameter of the substrate W. In one embodiment, when the diameter of the substrate W is 300 mm, the vertical length of the paddle 16 is 360 mm.

Figure 7:
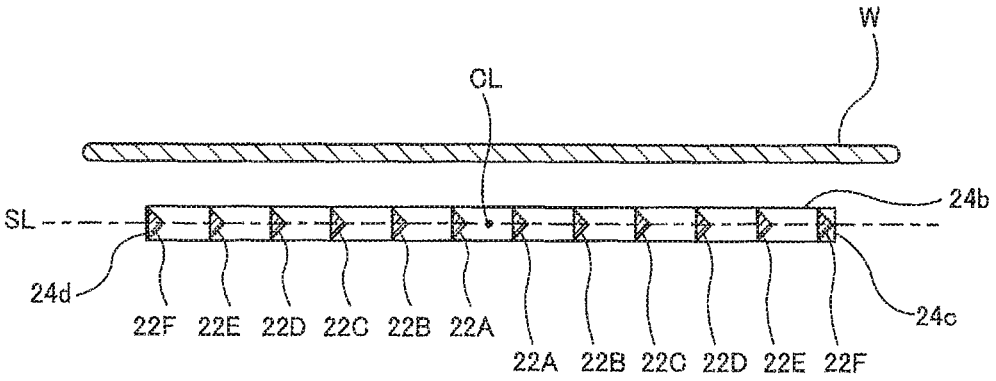
FIG. 7 is a cross-sectional view taken along the line C-C of FIG. 4.

FIG. 7 is a cross-sectional view taken along the line C-C of FIG. 4. As shown in FIG. 7, the agitation rods 22A to 22F have the same shape and are arranged at regular intervals. Thus, all the distances between adjacent agitation rods are equal. The agitation rods 22A to 22F all face in the same direction. More specifically, tip portions 42 (see FIG. 8) of the agitation rods 22A to 22F face toward the right end 24*c*. In an embodiment, the tip portions 42 of the agitation rods 22A to 22F may face toward the left end 24*d*.

Figure 8:
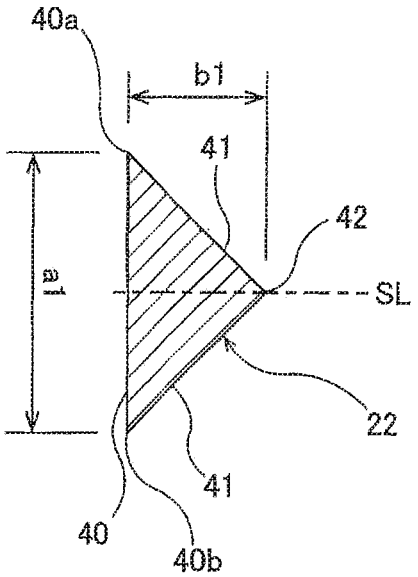
FIG. 8 is a horizontal cross-sectional view of an agitation rod.

FIG. 8 is a horizontal cross-sectional view of the agitation rod 22 which is a collective term for the agitation rods 22A to 22F. The agitation rod 22 has a planar portion 40 perpendicular to the reciprocating direction of the paddle 16, i.e. perpendicular to the direction parallel to the surface of the substrate W, two slope surfaces 41, 41 extending from both side ends 40*a*, 40*b* of the planar portion 40 in directions closer to each other, and a tip portion 42 located between the slope surfaces 41, 41 and connected with the slope surfaces 41, 41. In this embodiment the agitation rod 22 has the shape of a triangular prism. In other words, a horizontal cross-section of the agitation rod 22 has a triangular shape.

The slope surfaces 41, 41 are symmetric with respect to a center line SL of the agitation rod 22 (i.e. each of the agitation rods 22A to 22F). This center line SL is perpendicular to the planer portion 40. More specifically, the center line SL is a line parallel to the reciprocating direction of the paddle 16, i.e. parallel to the surface of the substrate W, and perpendicular to the center line CL (see FIG. 4) of the paddle 16.

As shown in FIG. 8, a ratio (b1/a1) of a distance b1 between the planar portion 40 and the tip portion 42 to a distance a1 between the side ends 40*a*, 40*b* of the planar portion 40 (i.e. the width of the planar portion 40) is in the range of 0.2 to 2.2 (b1/a1=0.2-2.2). This ratio (b1/a1) is preferably 0.5 (b1/a1=0.5). The distance a1 is generally in the range of 2 mm to 10 mm.

Figure 9A:
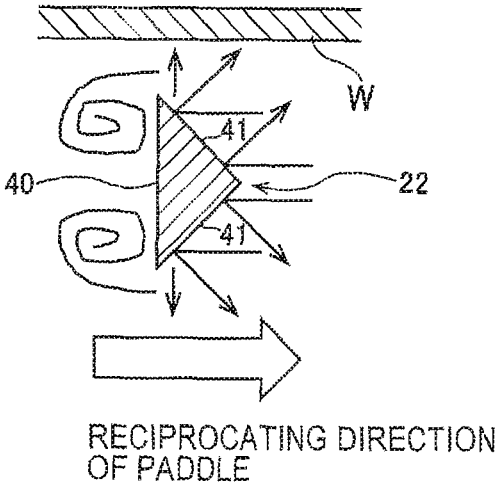
FIGS. 9A and 9B are diagrams illustrating flow of a plating solution, created by the agitation rod.
Figure 9B:
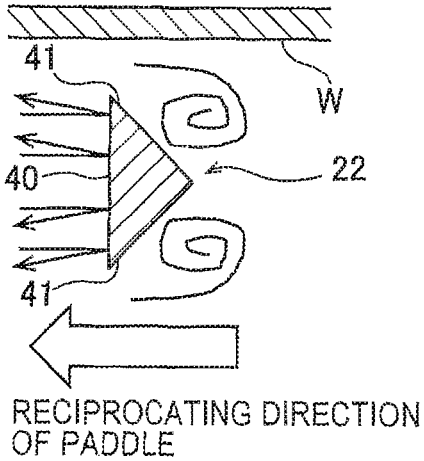

FIGS. 9A and 9B are diagrams illustrating the flow of the plating solution, created by the agitation rod 22. As shown in FIG. 9A, when the agitation rod 22 moves in the direction of the arrow (the direction in which the slope surfaces 41, 41 advance), the slope surfaces 41, 41 come into contact with the plating solution existing in front of the slope surfaces 41, 41, and the plating solution flows in a direction away from the slope surfaces 41, 41. The plating solution that has come into contact with the substrate W-side slope surface 41 of the two slope surfaces 41, 41 flows from the agitation rod 22 toward the substrate W and impinges on the surface of the substrate W As a result, the plating solution existing between the surface of the substrate W and the agitation rod 22 is agitated strongly.

The agitation rod 22 having the slope surfaces 41, 41 can thus create a flow that pushes the plating solution toward the surface of the substrate W. When the flow of the plating solution impinges on the surface of the substrate W, the plating solution that has been present in the vicinity of the surface of the substrate W is replaced with the new plating solution. This increases the supply of metal ions in the plating solution to the substrate W.

The plating solution which has come into contact with the non-substrate W-side slope surface 41 of the two slope surfaces 41, 41 flows in a direction away from the substrate W As described above, the slope surfaces 41, 41 are arranged symmetrically with respect to the center line SL of the agitation rod 22. Therefore, the plating solution that has come into contact with the slope surfaces 41, 41 flows symmetrically with respect to the center line SL. Accordingly, the plating-solution agitating powers, generated on the slope surfaces 41, 41, are balanced. This enables smooth reciprocation of the paddle 16.

An angle between the planar portion 40 and each slope surface 41 is preferably 45 degrees. This configuration enables part of the plating solution that has come into contact with the slope surfaces 41, 41 to flow in a direction perpendicular to the reciprocating direction of the paddle 16 and impinge on the surface of the substrate W at a right angle. Therefore, metal ions in the plating solution can be efficiently supplied to the surface of the substrate W.

As shown in FIG. 9A, when the agitation rod 22 moves in the direction of the arrow, the plating solution behind the agitation rod 22, i.e. around the planar portion 40, flows toward the planar portion 40. In particular, the agitation rod 22 having the planar portion 40 creates a swirling flow of the plating solution, which sucks in the plating solution that has come into contact with the substrate W and moves the plating solution toward the planar portion 40. This swirling flow of the plating solution is a flow which pulls the plating solution that has come into contact with the substrate W back toward the paddle 16. By creating such a swirling flow of the plating solution, the plating solution existing between the surface of the substrate W and the agitation rod 22 is agitated strongly.

The paddle 16 has a shape which creates the above-described two flows: a flow that pushes the plating solution toward the surface of the substrate W and a flow that pulls the plating solution back from the surface of the substrate W. The paddle 16 can therefore efficiently agitate the plating solution in the vicinity of the surface of the substrate W. Thus, according to this embodiment, the paddle 16 can generate an increased plating-solution agitating power without an increase in the reciprocating speed of the paddle 16. It therefore becomes possible to increase the supply of metal ions in the plating solution to the substrate W.

As shown in FIG. 9B, when the agitation rod 22 moves in the direction of the arrow (the direction in which the planar portion 40 advances), the planar portion 40 comes into contact with the plating solution existing in front of the planar portion 40, and the plating solution flows in a direction away from the planar portion 40. The plating solution around the slope surfaces 41, 41 flows toward the slope surfaces 41, 41.

While in the above-described embodiment the agitation rods 22A to 22F are disposed such that they face in the same direction, the agitation rods 22A to 22F may comprise first agitation rods that face in the same one direction and second agitation rods that face in the opposite direction.

Figure 10:
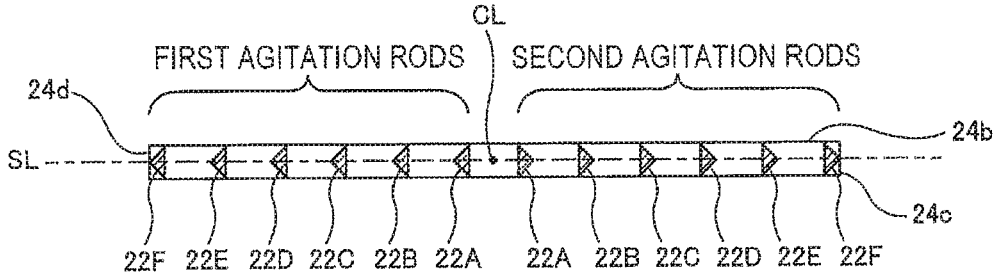
FIG. 10 is a diagram showing first agitation rods and second agitation rods, both facing toward the outer side of the paddle.

FIG. 10 is a diagram showing first agitation rods 22A to 22F and second agitation rods 22A to 22F, both facing toward the outer side of the paddle 16. In the embodiment shown in FIG. 10, the first agitation rods 22A to 22F are disposed at one side of the center line CL of the paddle 16, and the second agitation rods 22A to 22F are disposed at the opposite side of the center line CL of the paddle 16. The first agitation rods 22A to 22F and the second agitation rods 22A to 22F face toward the outer side of the paddle 16.

Figure 11:
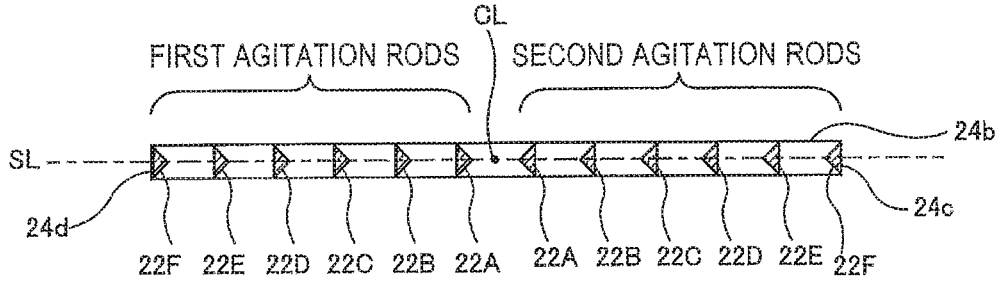
FIG. 11 is a diagram showing first agitation rods and second agitation rods, both facing toward a center line of the paddle.

FIG. 11 is a diagram showing first agitation rods 22A to 22F and second agitation rods 224 to 22F, both facing toward the center line CL of the paddle 16. In the embodiment shown in FIG. 11, the first agitation rods 22A to 22F are disposed at one side of the center line CL of the paddle 16, and the second agitation rods 22A to 22F are disposed at the opposite side of the center line CL of the paddle 16. The first agitation rods 22A to 22F and the second agitation rods 22A to 22F face toward the center line CL of the paddle 16.

Figure 12:
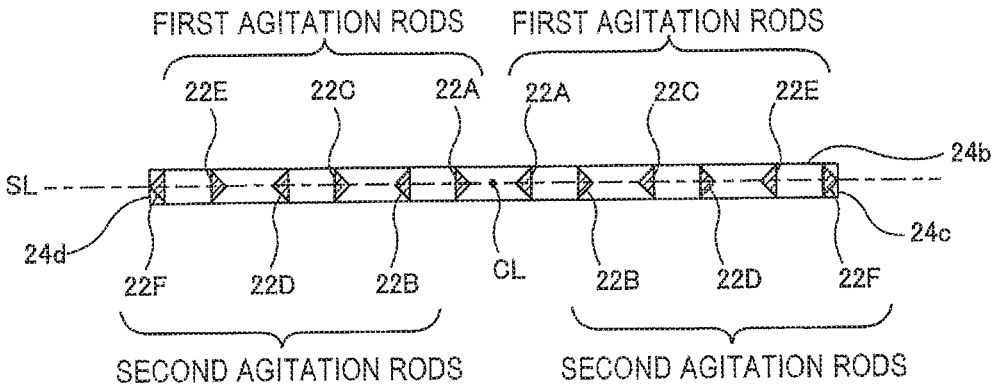
FIG. 12 is a diagram showing first agitation rods and second agitation rods which are arranged alternately.
Figure 13:
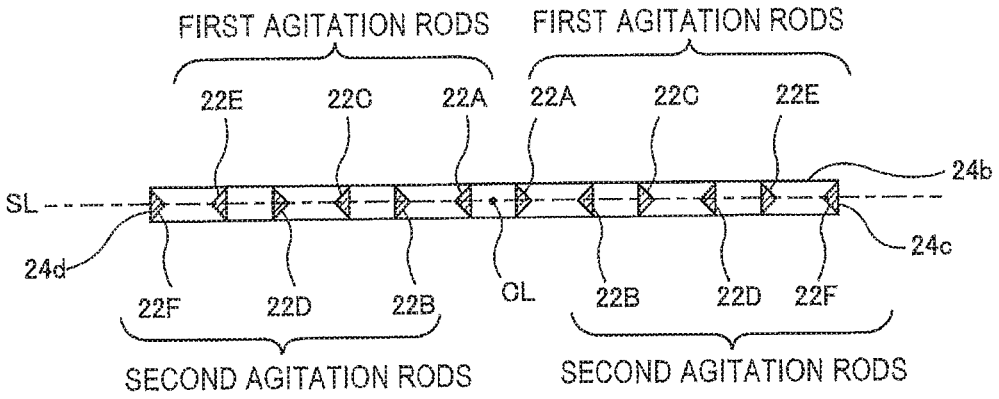
FIG. 13 is a diagram showing first agitation rods and second agitation rods which are arranged alternately.

FIGS. 12 and 13 are diagrams showing first agitation rods 22 and second agitation rods 22, which are arranged alternately. As shown in FIGS. 12 and 13, the first agitation rods 22 and the second agitation rods 22 may be disposed alternately.

In the embodiment shown in FIG. 12, the first agitation rods are agitation rods 22A, 22C, 22E, while the second agitation rods are agitation rods 22B, 22D, 22F. The first agitation rod 22A, the second agitation rod 22B, the first agitation rod 22C, the second agitation rod 22D, the first agitation rod 22E and the second agitation rod 22F are arranged in this order in a direction away from the center line CL of the paddle 16. The tip portions 42 of the first agitation rods 22A, 22C, 22E face toward the center line CL of the paddle 16, while the tip portions 42 of the second agitation rods 22B, 22D, 22F face toward the outer side of the paddle 16.

Also in the embodiment shown in FIG. 13, the first agitation rods are agitation rods 22A, 22C, 22E, while the second agitation rods are agitation rods 22B, 22D, 22F. The first agitation rod 22A, the second agitation rod 22B, the first agitation rod 22C, the second agitation rod 22D, the first agitation rod 22E and the second agitation rod 22F are arranged in this order in a direction away from the center line CL of the paddle 16. The tip portions 42 of the first agitation rods 22A, 22C, 22E face toward the outer side of the paddle 16, while the tip portions 42 of the second agitation rods 22B, 22D, 22F face toward the center line CL of the paddle 16.

Figure 14:
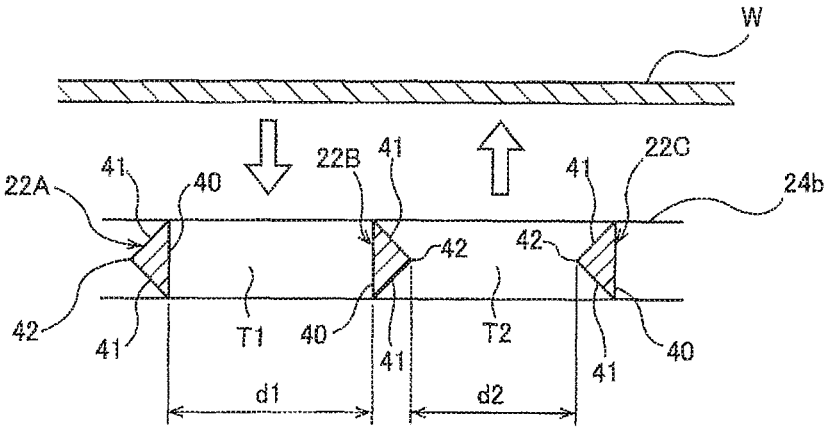
FIG. 14 is a diagram illustrating a distance between two adjacent planar portions and a distance between two adjacent tip portions.

FIG. 14 is a diagram illustrating a distance d1 between two adjacent planar portions 40 and a distance d2 between two adjacent tip portions 42. Only the agitation rods 22A to 22C of agitation rods 22A to 22F are shown in FIG. 14. The agitation rods 22A to 22F include first agitation rods and second agitation rods which alternately face in opposite directions. A first distance d1 is formed between planar portions 40 of a first agitation rod (e.g. agitation rod 22A in FIG. 14) and an adjacent second agitation rod (e.g. agitation rod 22B in FIG. 14), which face away from each other, of the agitation rods 22A to 22F. A second distance d2 is formed between tip portions 42 of a first agitation rod (e.g. agitation rod 22C in FIG. 14) and an adjacent second agitation rod (e.g. agitation rod 22B in FIG. 14), which face each other, of the agitation rods 22A to 22F. The first distance d1 may differ from the second distance d2 and, in this embodiment, the first distance d1 is larger than the second distance d2 (d1>d2).

Figure 15A:
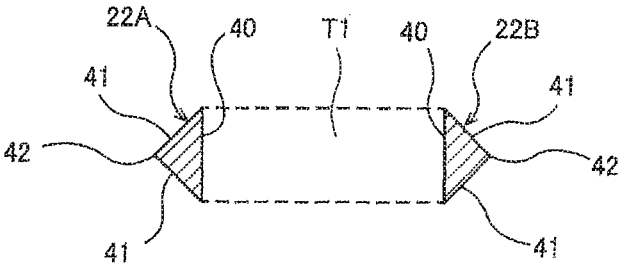
FIG. 15A is a diagram illustrating a size of a first flow passage.
Figure 15B:
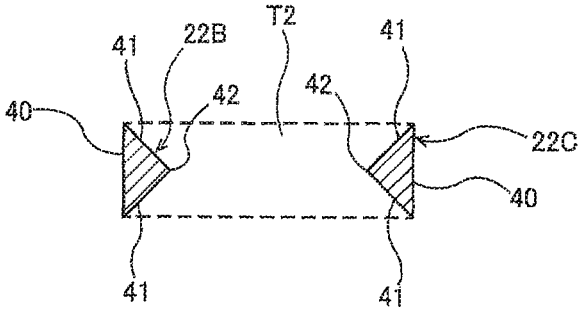
FIG. 15B is a diagram illustrating a size of a second flow passage.

FIG. 15A is a diagram illustrating a size of a first flow passage T1, and FIG. 15B is a diagram illustrating a size of a second flow passage T2. FIG. 15A depicts horizontal cross-sections of the agitation rods 22A, 22B, and FIG. 159 depicts horizontal cross-sections of the agitation rods 22B, 22C. As shown in FIG. 15A, a first flow passage T1 is formed between the first agitation rod 22A and the adjacent second agitation rod 229 which face in the opposite directions, i.e., face away from each other. This first flow passage T1 is formed by the planar portion 40 of the agitation rod 22A, the planar portion 40 of the agitation rod 22B, and the holding members 24*a*, 24*b*.

As shown in FIG. 15B, a second flow passage T2 is formed between the first agitation rod 22C and the adjacent second agitation rod 22B which face each other. The second flow passage T2 is formed by the slope surfaces 41, 41 and the tip portion 42 of the agitation rod 22B, the slope surfaces 41, 41 and the tip portion 42 of the agitation rod 22C, and the holding members 24*a*, 24*b*.

The first flow passage T1 is a flow passage which creates a flow that pulls back the plating solution from the surface of the substrate W The second flow passage T2 a flow passage which creates a flow that pushes the plating solution toward the surface of the substrate W.

In this embodiment a volume of the first flow passage T1 is equal to a volume of the second flow passage T2. When the volume of the first flow passage T1 is equal to the volume of the second flow passage T2, the amount of the plating solution that is pushed toward the substrate W by the reciprocating paddle 16 is equal to the amount of the plating solution that is pulled back from the substrate W to the paddle 16. Therefore, the paddle 16 can replace (agitate) the plating solution most efficiently.

Figure 16:
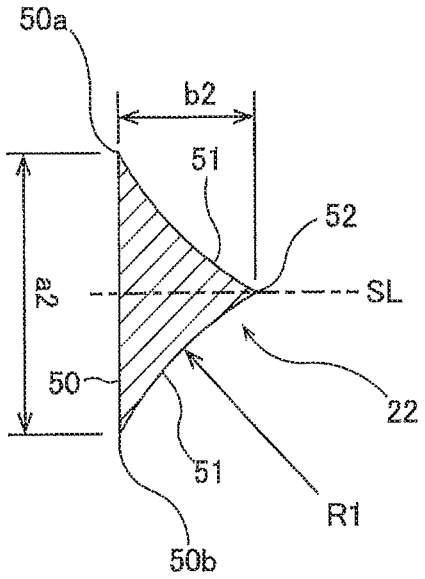
FIG. 16 is a diagram showing another embodiment of an agitation rod.

FIG. 16 is a diagram showing another embodiment of an agitation rod 22. The construction and the operation of this embodiment, not particularly described here, are the same as those of the above-described embodiment, and a duplicate description thereof is omitted. In the embodiment shown in FIG. 16, the agitation rod 22 has two slope surfaces 51, 51. The slope surfaces 51, 51 are curved concave surfaces extending from side ends 50*a*, 50*b* of a planar portion 50 in directions closer to each other. Thus, a horizontal cross-section of the agitation rod 22 has the shape of a curved triangle.

In this embodiment, a ratio (b2/a2) of a distance b2 between the planar portion 50 and a tip portion 52 to a distance a2 between the side ends 50*a*, 50*b* of the planar portion 50 the width of the planar portion 50) is in the range of 0.2 to 2.2 (b2/a2=0.2-2.2). A ratio (R1/a2) of a radius of curvature R1 of each slope surface 51 to the distance a2 is in the range of 0.4 to 1.7 (R1/a2=0.4-1.7). The distance a2 is generally in the range of 2 mm to 10 mm.

The ratio (b2/a2) of the distance b2 to the distance a2 is preferably 0.5 (b2/a2=0.5). A ratio (R1/(2×a2)) of the radius of curvature R1 to the distance a2 multiplied by 2 is preferably 0.5 ((R1/(2×a2))=0.5). Thus, it is preferred that both the ratio (b2/a2) and the ratio (R1/(2×a2)) be 0.5 ((b2/a2)=(R1/(2×a2))=0.5).

Figure 17A:
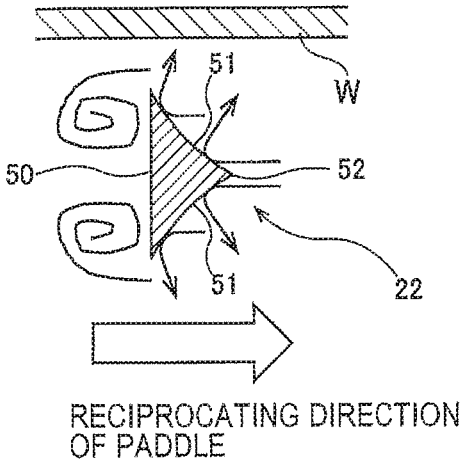
FIGS. 17A and 17B are diagrams illustrating flow of a plating solution, created by the agitation rod.
Figure 17B:
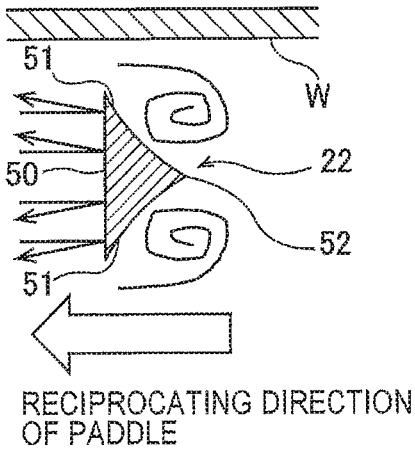

FIGS. 17A and 17B are diagrams illustrating the flow of the plating solution, created by the agitation rod 22. As shown in FIG. 17A, when the agitation rod 22 moves in the direction of the arrow (the direction in which the slope surfaces 51, 51 advance), the slope surfaces 51, 51 come into contact with the plating solution existing in front of the slope surfaces 51, 51, and the plating solution flows in a direction away from the slope surfaces 51, 51. Thus, also in this embodiment, the agitation rod 22 can create a flow that pushes the plating solution toward the surface of the substrate W.

As shown in FIG. 17A, when the agitation rod 22 moves in the direction of the arrow, the plating solution behind the agitation rod 22, i.e. around the planar portion 50, flows toward the planar portion 50. Thus, also in this embodiment, the agitation rod 22 can create a swirling flow which pulls the plating solution that has come into contact with the substrate W back to the paddle 16.

As shown in FIG. 17B, when the agitation rod 22 moves in the direction of the arrow (the direction in which the planar portion 50 advances), the planar portion 50 comes into contact with the plating solution existing in front of the planar portion 50, and the plating solution flows in a direction away from the planar portion 50. The plating solution around the slope surfaces 51, 51 flows toward the slope surfaces 51, 51.

Figure 18:
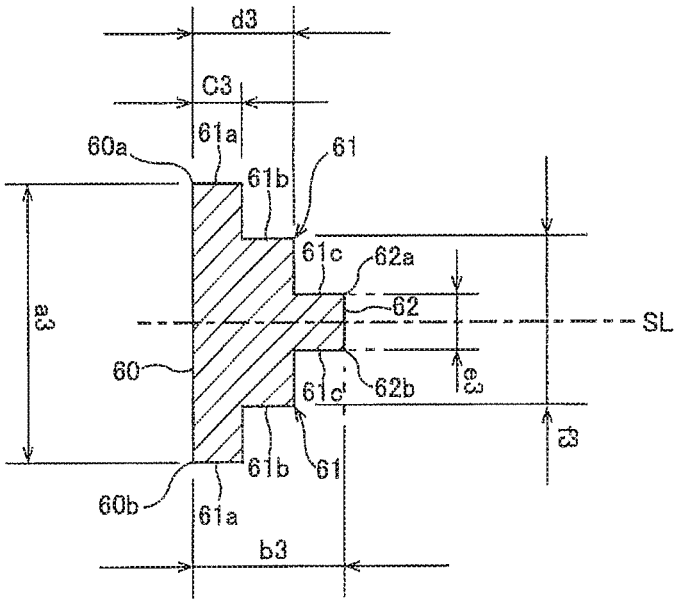
FIG. 18 is a diagram showing yet another embodiment of an agitation rod.

FIG. 18 is a diagram showing yet another embodiment of an agitation rod 22. The construction and the operation of this embodiment, not particularly described here, are the same as those of the above-described embodiment(s), and a duplicate description thereof is omitted. In the embodiment shown in FIG. 18, the agitation rod 22 has two slope surfaces 61, 61. Each slope surface 61 has a plurality of (three in this embodiment) stepped portions 61*a*, 61*b*, 61*c*. A tip portion 62 is a surface that extends parallel to a planar portion 60, i.e. perpendicular to the direction of the reciprocating movement of the paddle 16. The slope surfaces 61, 61 are connected with side surfaces 60*a*, 60*b* of the planar portion 60 and side ends 62*a*, 62*b* of the tip portion 62.

In this embodiment, a ratio (b3/a3) of a distance b3 between the planar portion 60 and the tip portion 62 to a distance a3 between the side ends 60*a*, 60*b* of the planar portion 60 (i.e. the width of the planar portion 60) is in the range of 0.2 to 2.2 (b3/a3=0.2-2.2). This ratio (b3/a3) is preferably 1.

A distance e3 between the side ends 62*a*, 62*b* of the tip portion 62 (i.e. the width of the tip portion 62) is larger than 0 and smaller the distance a3 (0<e3<a3). A ratio (a3/c3) of the distance a3 to a distance c3, which is the height of the stepped portion 61*a*, is equal to a numerical value obtained by adding 1 to the number n (integer) of steps of the slope surface 61 (a3/c3=n (integer)+1).

A ratio (a3:b3) between the distance a3 and the distance b3 is equal to a ratio (e3:c3) between the distance e3 and the distance c3 (a3:b3=e3:c3). A ratio (d3/c3) of a distance d3, which is the sum of the height of the stepped portion 61*a* and the height of the stepped portion 61*b*, to the distance c3 is 2 (d3/c3=2), A ratio (f3/e3) of a distance f3 between the stepped portions 61*b*, 61*b* to the distance e3 is 2 (f3/e3=2). Thus, both the ratio (d3/c3) and the ratio (f3/e3) are 2 (d3/c3=e3/e3=2).

It is preferred that both the distance c3 and the distance e3 be equal to a numerical value obtained by dividing the distance a3 by 3 (c3=e3=a3/3). The distance a3 is generally in the range of 2 mm to 10 mm.

Figure 19A:
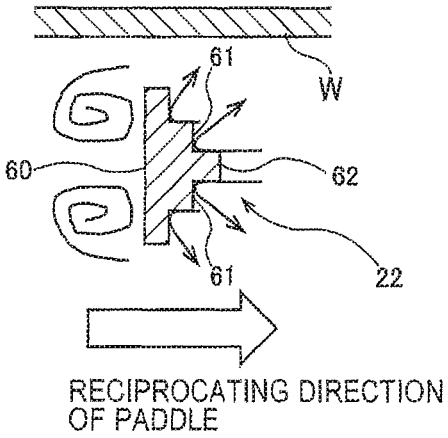
FIGS. 19A and 19B are diagrams illustrating flow of a plating solution, created by the agitation rod.
Figure 19B:
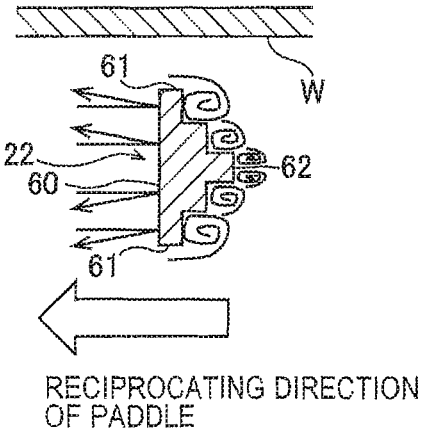

FIGS. 19A and 19B are diagrams illustrating the flow of the plating solution, created by the agitation rod 22. As shown in FIG. 19A, when the agitation rod 22 moves in the direction of the arrow (the direction in which the slope surfaces 61, 61 advance), the slope surfaces 61, 61 and the tip portion 62 conic into contact with the plating solution existing in front of them, and the plating solution flows in a direction away from the slope surfaces 61, 61 and the tip portion 62. Thus, in this embodiment, the agitation rod 22, with the stepped portions 61*a* to 61*c* of the slope surfaces 61, 61, can create a flow that pushes the plating solution toward the surface of the substrate W.

As shown in FIG. 19A, when the agitation rod 22 moves in the direction of the arrow, the plating solution behind the agitation rod 22, i.e. around the planar portion 60, flows toward the planar portion 60. Thus, also in this embodiment, the agitation rod 22 can create a swirling flow which pulls the plating solution that has come into contact with the substrate W back to the paddle 16.

As shown in FIG. 19B, when the agitation rod 22 moves in the direction of the arrow (the direction in which the planar portion 60 advances), the planar portion 60 comes into contact with the plating solution existing in front of the planar portion 60, and the plating solution flows in a direction away from the planar portion 60. The plating solution around the slope surfaces 61, 61 flows toward the slope surfaces 61, 61. Swirling flows of the plating solution are created by the stepped portions 61*a* to 61*c* of the slope surfaces 61, 61 and by the tip portion 62.

Figure 20:
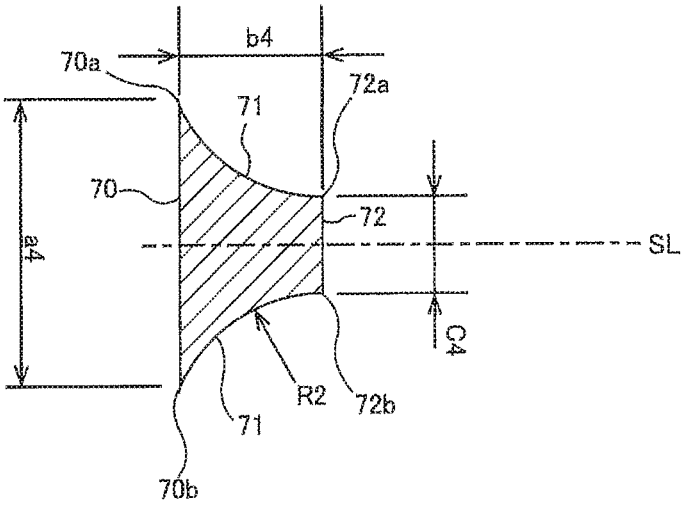
FIG. 20 is a diagram showing yet another embodiment of an agitation rod.

FIG. 20 is a diagram showing yet another embodiment of an agitation rod 22. The construction and the operation of this embodiment, not particularly described here, are the same as those of the above-described embodiment(s), and a duplicate description thereof is omitted. In the embodiment shown in FIG. 20, the agitation rod 22 has two slope surfaces 71, 71. These slope surfaces 71, 71 are curved concave surfaces extending from side ends 70*a*, 70*b* of a planar portion 70 in directions closer to each other. A tip portion 72 is a surface that extends parallel to the planar portion 70, i.e. perpendicular to the direction of the reciprocating movement of the paddle 16. The slope surfaces 71, 71 are connected with the side surfaces 70*a*, 70*b* of the planar portion 70 and side ends 72*a*, 72*b* of the tip portion 72.

In this embodiment, a ratio (b4/a4) of a distance b4 between the planar portion 70 and the tip portion 72 to a distance a4 between the side ends 70*a*, 70*b* of the planar portion 70 (i.e. the width of the planar portion 70) is in the range of 0.4 to 2.2 (b4/a4=0.4-2.2). This ratio (b4/a4) is preferably 0.5 (b4/a4=0.5). A distance c4 between the side ends 72*a*, 72*b* of the tip portion 72 (i.e. the width of the tip portion 72) is larger than 0 and smaller the distance a4 (0<c4<a4). The distance c4 is preferably equal to a numerical value obtained by dividing the distance a4 by 3 (c4=a4/3).

A radius of curvature R2 of each slope surface 71 is larger than 0 and smaller than a numerical value obtained by multiplying the distance a4 by 2 (0<R2<(2×a4)). The radius of curvature R2 is preferably equal to a numerical value (a4/2) obtained by dividing the distance a4 by 2 (R2=a4/2). The distance a4 is generally in the range of 2 mm to 10 mm.

Figure 21A:
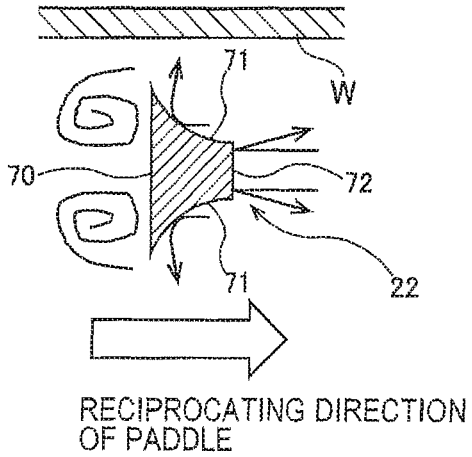
FIGS. 21A and 21B are diagrams illustrating flow of a plating solution, created by the agitation rod.
Figure 21B:
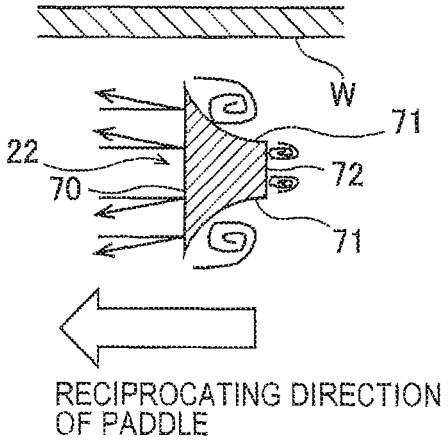

FIGS. 21A and 21B are diagrams illustrating the flow of the plating solution, created by the agitation rod 22. As shown in FIG. 21A, when the agitation rod 22 moves in the direction of the arrow (the direction in which the slope surfaces 71, 71 advance), the slope surfaces 71, 71 and the tip portion 72 come into contact with the plating solution existing in front of them, and the plating solution flows in a direction away from the slope surfaces 71, 71 and the tip portion 72. Thus, also in this embodiment, the agitation rod 22 can create a flow that pushes the plating solution toward the surface of the substrate W.

As shown in FIG. 21A, when the agitation rod 22 moves in the direction of the arrow, the plating solution behind the agitation rod 22, i.e. around the planar portion 70, flows toward the planar portion 70. Thus, also in this embodiment, the agitation rod 22 can create a swirling flow which pulls the plating solution that has come into contact with the substrate W back to the paddle 16.

As shown in FIG. 21B, when the agitation rod 22 moves in the direction of the arrow (the direction in which the planar portion 70 advances), the planar portion 70 comes into contact with the plating solution existing in front of the planar portion 70, and the plating solution flows in a direction away from the planar portion 70. The plating solution around the slope surfaces 71, 71 and the tip portion 72 flows toward the slope surfaces 71, 71 and the tip portion 72. Swirling flows of the plating solution are created by the slope surfaces 71, 71 and the tip portion 72.

Figure 22:
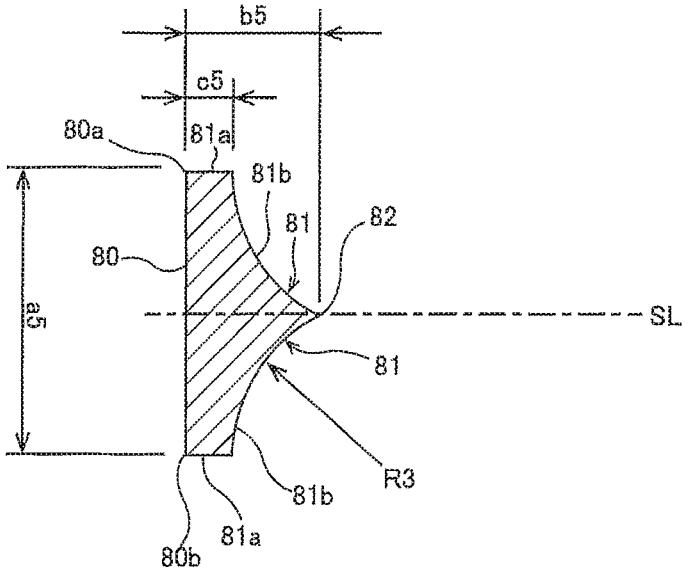
FIG. 22 is a diagram showing yet another embodiment of an agitation rod.

FIG. 22 is a diagram showing yet another embodiment of an agitation rod 22. The construction and the operation of this embodiment, not particularly described here, are the same as those of the above-described embodiment(s), and a duplicate description thereof is omitted. In the embodiment shown in FIG. 22, the agitation rod 22 has two slope surfaces 81, 81. The slope surfaces 81, 81 comprise parallel surfaces 81*a*, 81*a* extending parallel to the center line SL of the agitation rod 22 from side ends 80*a*, 80*b* of a planar portion 80, and curved concave surfaces 81*b*, 81*b* extending from the parallel surfaces 81*a*, 81*a* *in directions closer to each other.*

In this embodiment, a ratio (b5/a5) of a distance b5 between the planar portion 80 and a tip portion 82 to a distance a5 between the side ends 80*a*, 80*b* of the planar portion 80 (i.e. the width of the planar portion 80) is in the range of 0.2 to 2.2 (b5/a5=0.2-2.2). This ratio (b5/a5) is preferably 0.5. A distance c5, which is the width of each parallel surface 81*a*, is larger than 0 and smaller than the distance b5 (0<c5<b5). The distance c5 is preferably equal to a numerical value obtained by dividing the distance a5 by 6 (c5=a5/6).

A radius of curvature R3 of each curved surface 81*b* is larger than 0 and smaller than a numerical value obtained by multiplying the distance a5 by 2 (0<R3<(2×a5)). The radius of curvature R3 is preferably equal to a numerical value obtained by dividing the distance a5 by 2. The distance a5 is generally in the range of 2 mm to 10 mm.

Figure 23A:
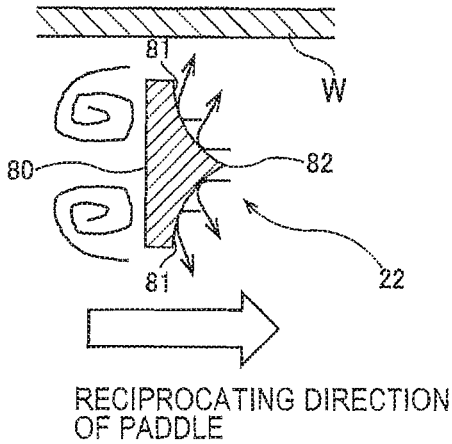
FIGS. 23A and 23B are diagrams illustrating flow of a plating solution, created by the agitation rod.
Figure 23B:
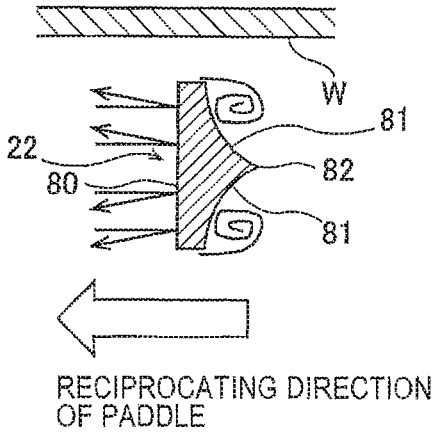

FIGS. 23A and 23B are diagrams illustrating the flow of the plating solution, created by the agitation rod 22. As shown in FIG. 23A, when the agitation rod 22 moves in the direction of the arrow (the direction in which the slope surfaces 81, 81 advance), the slope surfaces 81, 81 come into contact with the plating solution existing in front of the slope surfaces 81, 81, and the plating solution flows in a direction away from the slope surfaces 81, 81 (more specifically from the curved surfaces 81*b*, 81*b*). Thus, also in this embodiment, the agitation rod 22 can create a flow that pushes the plating solution toward the surface of the substrate W.

As shown in FIG. 23.A, when the agitation rod 22 moves in the direction of the arrow, the plating solution behind the agitation rod 22, i.e. around the planar portion 80, flows toward the planar portion 80. Thus, also in this embodiment, the agitation rod 22 can create a swirling flow which pulls the plating solution that has come into contact with the substrate W back to the paddle 16.

As shown in FIG. 239, when the agitation rod 22 moves in the direction of the arrow (the direction in which the planar portion 80 advances), the planar portion 80 comes into contact with the plating solution existing in front of the planar portion 80, and the plating solution flows in a direction away from the planar portion 80. The plating solution around the slope surfaces 81, 81 flows toward the slope surfaces 81, 81. Swirling flows of the plating solution are created by the slope surfaces 81, 81.

FIG. 24 is a diagram showing yet another embodiment of an agitation rod 22. The construction and the operation of this embodiment, not particularly described here, are the same as those of the above-described embodiment(s), and a duplicate description thereof is omitted. In the embodiment shown in FIG. 24, the agitation rod 22 has two slope surfaces 91, 91. The slope surfaces 91, 91 comprise parallel surfaces 91*a*, 91*a* extending parallel to the center line SL of the agitation rod 22 from side ends 90*a*, 90*b* of a planar portion 90, and curved concave surfaces 91*b*, 91*b* extending from the parallel surfaces 91*a*, 91*a* in directions closer to each other.

In this embodiment, a ratio (b6/a6) of a distance b6 between the planar portion 90 and a tip portion 92 to a distance a6 between the side ends 90*a*, 90*b* of the planar portion 90 (i.e. the width of the planar portion 90) is in the range of 0.2 to 2.2 (b6/a6=0.2-2.2). This ratio (b6/a6) is preferably 1 (b6/a6=1). A distance c6, which is the width of each parallel surface 91*a*, is larger than 0 and smaller than the distance b6 (0<c6<b6). The distance c6 is preferably equal to a numerical value obtained by dividing the distance b6 by 3 (c6=b6/3).

The tip portion 92 is a surface that extends parallel to the planar portion 90, i.e. perpendicular to the direction of the reciprocating movement of the paddle 16. The distance d6 between the side ends 92*a*, 92*b* of the tip portion 92 (i.e. the width of the tip portion 92) is larger than 0 and smaller the distance a6 (0<d6<a6). A radius of curvature R4 of the curved surface 91*b* of each slope surface 91 is larger than 0 and smaller than a numerical value obtained by multiplying the distance a6 by 2 (0<R4<(2×a6)). The radius of curvature R4 is preferably equal to a numerical value obtained by diving the distance a6 by 3, and the distance d6 is also preferably equal to a numerical value obtained by dividing the distance a6 by 3 (R4=d6=a6/3). The distance a6 is generally in the range of 2 mm to 10 mm.

Figure 25A:
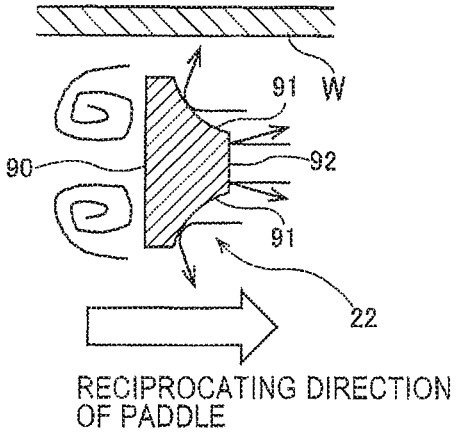
FIGS. 25A and 25B are diagrams illustrating flow of a plating solution, created by the agitation rod.
Figure 25B:
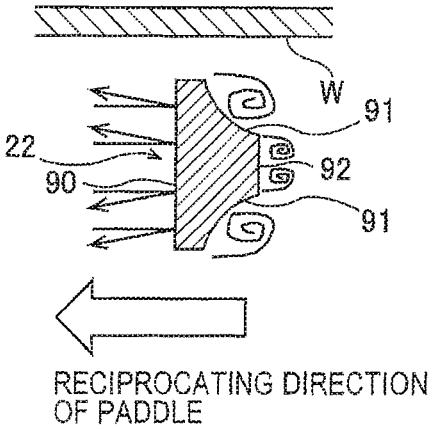

FIGS. 25A and 25B are diagrams illustrating the flow of the plating solution, created by the agitation rod 22. As shown in FIG. 25A, when the agitation rod 22 moves in the direction of the arrow (the direction in which the slope surfaces 91, 91 advance), the slope surfaces 91, 91 come into contact with the plating solution existing in front of the slope surfaces 91, 91, and the plating solution flows in a direction away from the slope surfaces 91, 91 (more specifically from the curved surfaces 91*b*, 91*b*) and the tip portion 92. Thus, also in this embodiment, the agitation rod 22 can create a flow that pushes the plating solution toward the surface of the substrate W.

As shown in FIG. 25A, when the agitation rod 22 moves in the direction of the arrow, the plating solution behind the agitation rod 22, i.e. around the planar portion 90, flows toward the planar portion 90. Thus, also in this embodiment, the agitation rod 22 can create a swirling flow which pulls the plating solution that has come into contact with the substrate W back to the paddle 16.

As shown in FIG. 25B, when the agitation rod 22 moves in the direction of the arrow (the direction in which the planar portion 90 advances), the planar portion 90 comes into contact with the plating solution existing in front of the planar portion 90, and the plating solution flows in a direction away from the planar portion 90. The plating solution around the slope surfaces 91, 91 flows toward the slope surfaces 91, 91 and the tip portion 92. Swirling flows of the plating solution are created by the slope surfaces 91, 91 and the tip portion 92.

Figure 26:
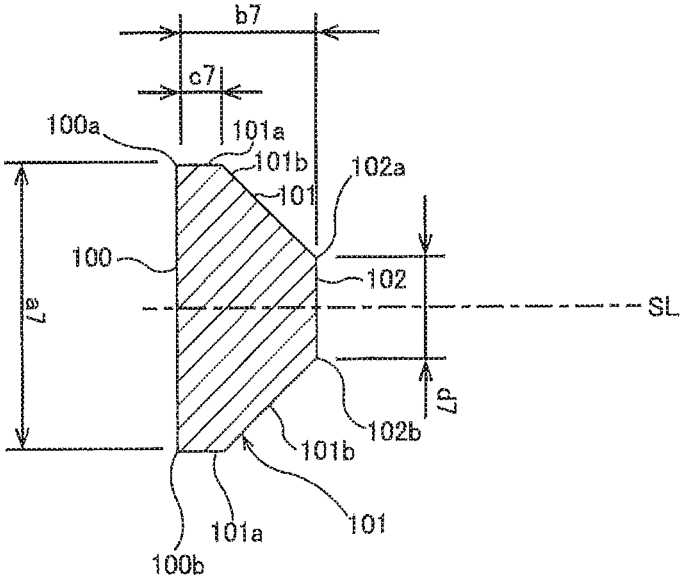
FIG. 26 is a diagram showing yet another embodiment of an agitation rod.

FIG. 26 is a diagram showing yet another embodiment of an agitation rod 22. The construction and the operation of this embodiment, not particularly described here, are the same as those of the above-described embodiment(s), and a duplicate description thereof is omitted. In the embodiment shown in FIG. 26, the agitation rod 22 has two slope surfaces 101, 101. The slope surfaces 101, 101 comprise parallel surfaces 101*a*, 101*a* extending parallel to the center line SL of the agitation rod 22 from side ends 100*a*, 100*b* of a planar portion 100, and neighboring surfaces 101*b*, 101*b* extending from the parallel surfaces 101*a*, 101*a* in directions closer to each other.

In this embodiment, a ratio (b7/a7) of a distance b7 between the planar portion 100 and a tip portion 102 to a distance a7 between the side ends 100*a*, 100*b* of the planar portion 100 (i.e. the width of the planar portion 100) is in the range of 0.2 to 2.2 (b7/a7=0.2-2.2). This ratio (b7/a7) is preferably 0.5 (b7/a7=0.5). A distance c7, which is the width of each parallel surface 101*a*, is larger than 0 and smaller than the distance b7 (0<c7<b7). The distance c7 is preferably equal to a numerical value obtained by diving the distance b7 by 3 (c7=b7/3).

The tip portion 102 is a surface that extends parallel to the planar portion 100, i.e. perpendicular to the direction of the reciprocating movement of the paddle 16. A distance d7 between the side ends 102*a*, 102*b* of the tip portion 102 (i.e. the width of the tip portion 102) is larger than 0 and smaller the distance a7 (0<d7<a7). The distance d7 is preferably equal to a numerical value obtained by diving the distance a7 by 6 (d7=a7/6). The distance a7 is generally in the range of 2 mm to 10 mm.

Figure 27A:
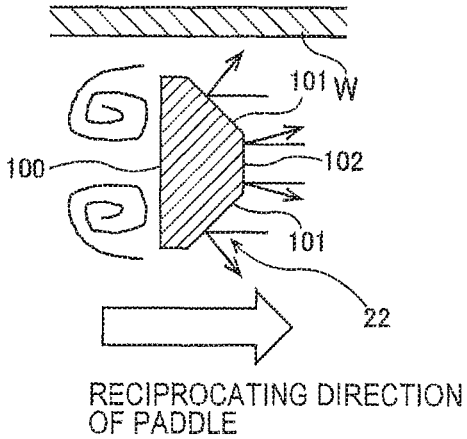
FIGS. 27A and 27B are diagrams illustrating flow of a plating solution, created by the agitation rod.
Figure 27B:
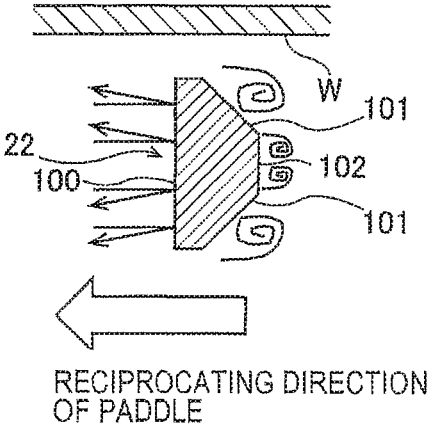

FIGS. 27A and 27B are diagrams illustrating the flow of the plating solution, created by the agitation rod 22. As shown in FIG. 27A, when the agitation rod 22 moves in the direction of the arrow (the direction in which the slope surfaces 101, 101 advance), the slope surfaces 101, 101 come into contact with the plating solution existing in front of the slope surfaces 101, 101, and the plating solution flows in a direction away from the neighboring surfaces 101*b*, 101*b* of the slope surfaces 101, 101 and the tip portion 102. Thus, also in this embodiment, the agitation rod 22 can create a flow that pushes the plating solution toward the surface of the substrate W.

As shown in FIG. 27A, when the agitation rod 22 moves in the direction of the arrow, the plating solution behind the agitation rod 22, i.e. around the planar portion 100, flows toward the planar portion 100. Thus, also in this embodiment, the agitation rod 22 can create a swirling flow which pulls the plating solution that has come into contact with the substrate W back to the paddle 16.

As shown in FIG. 279, when the agitation rod 22 moves in the direction of the arrow (the direction in which the planar portion 100 advances), the planar portion 100 comes into contact with the plating solution existing in front of the planar portion 100, and the plating solution flows in a direction away from the planar portion 100. The plating solution around the slope surfaces 101, 101 and the tip portion 102 flows toward the slope surfaces 101, 101 and the tip portion 102.

Figure 28A:
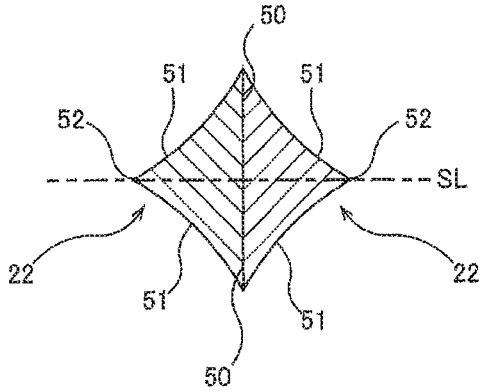
FIG. 28A, FIG. 28B, and FIG. 28C are diagrams showing exemplary agitation rod assemblies each comprising a combination of agitation rods according to the above-described embodiments.
Figure 28B:
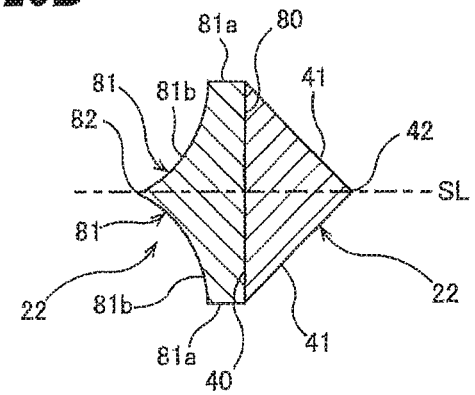
Figure 28C:
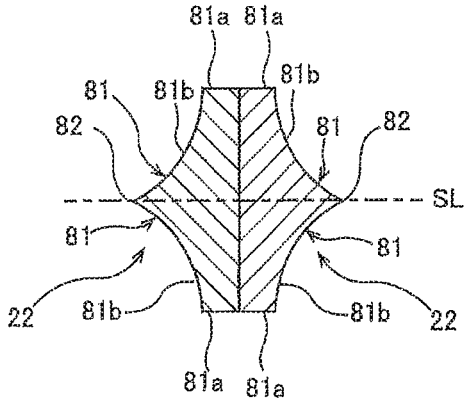
Figure 32:
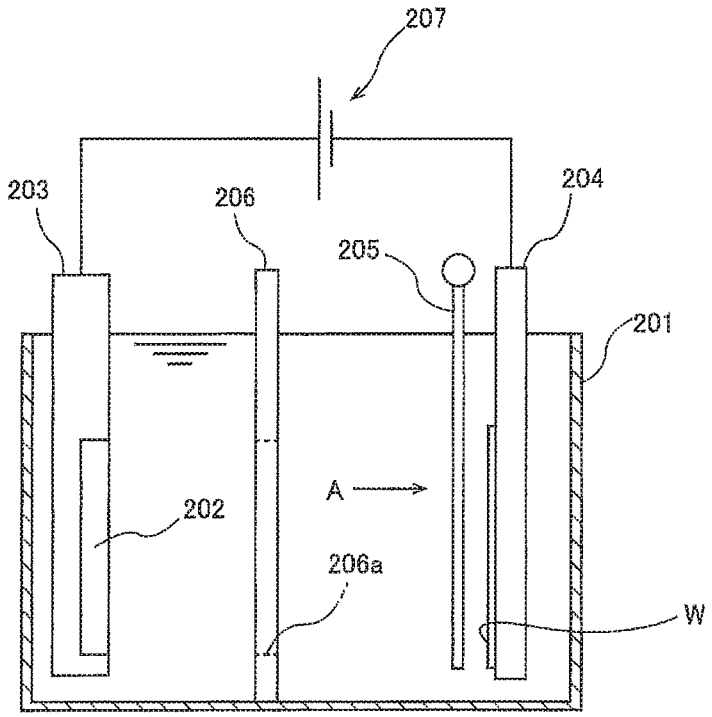
FIG. 32 is a schematic view of a plating apparatus.
Figure 33:
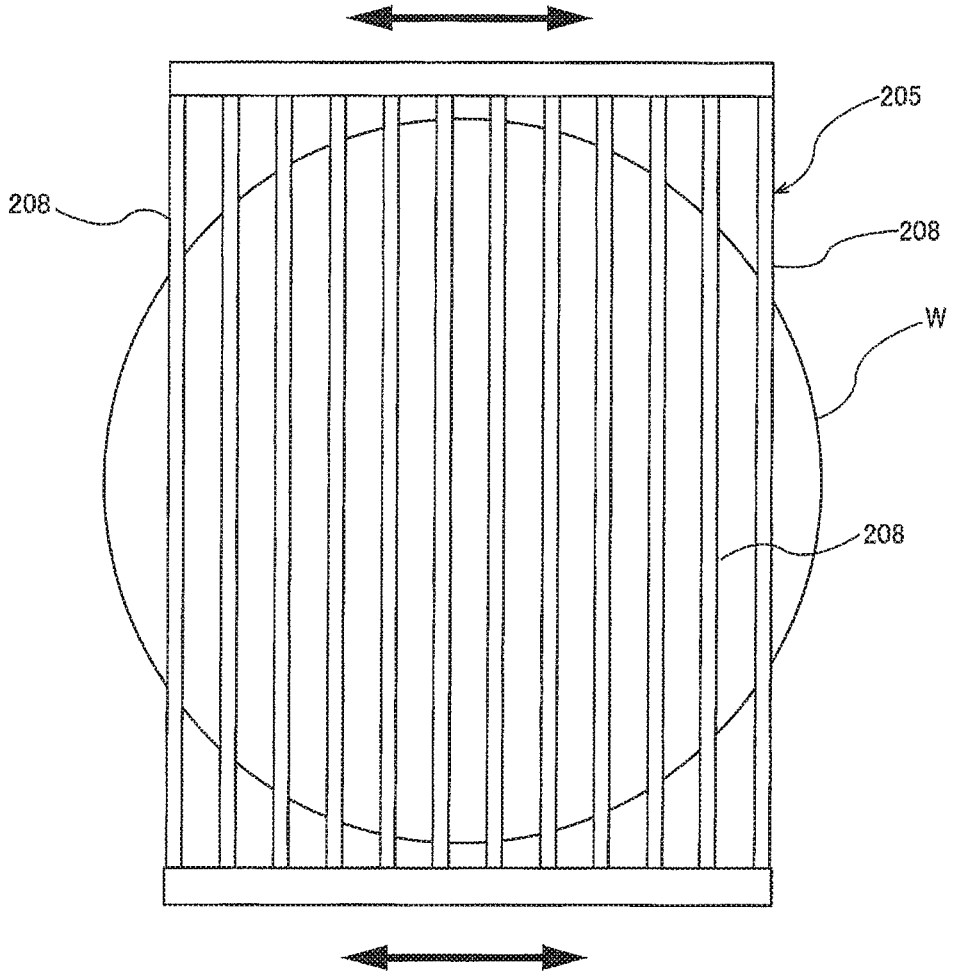
FIG. 33 is a diagram showing the paddle and the substrate of FIG. 32, as viewed from the direction of line A.

The agitation rods 22 according to the embodiments shown in FIGS. 8, 16, 18, 20, 22, 24 and 26 may be combined arbitrarily. FIGS. 28A, 28B, and 28C show exemplary agitation rod assemblies each comprising a combination of agitation rods 22 according to the above-described embodiments. The agitation rod assembly shown in FIG. 28A is composed of a combination of the two agitation rods 22 shown in FIG. 16. The planar portions 50, 50 of the two agitation rods 22 are in contact with each other. Therefore, a horizontal cross-section of the agitation rod assembly has a quadrangular shape having curved sides.

The agitation rod assembly shown in FIG. 28B is composed of a combination of the agitation rod 22 shown in FIG. 8 and the agitation rod 22 shown in FIG. 22. The agitation rod assembly shown in FIG. 28C is composed of a combination of the two agitation rods 22 shown in FIG. 22.

Each of the agitation rod assemblies may have an integral structure. Though not shown diagrammatically, an agitation rod assembly, depending on the combination of the agitation rods 22, may be disposed on the center line CL (see FIG. 4) of the paddle 16.

FIG. 29 is a diagram showing results of an experiment which was conducted to determine the agitating performances of agitation rods 22 according to the above-described embodiments. In the experiment shown in FIG. 29, plating was performed on a substrate W in which a bump pattern of holes, each having a diameter of 150 μm and a depth of 120 μm, is formed in a photoresist layer on a seed layer, while a current density on the substrate W was measured. As shown in FIG. 29, the following agitation rods 22 were used: the agitation rod 22 having the shape of FIG. 28A; the agitation rod 22 having the shape of FIG. 8; the agitation rod 22 having the shape of FIG. 28B; the agitation rod 22 having the shape of FIG. 28C; the agitation rod 22 having the shape of FIG. 18; and the agitation rod 22 having the shape of FIG. 24. Further, an agitation rod having a conventional shape (e.g. a rectangular prismatic shape) was used for comparison.

When the current density is increased, there exists a particular current density, called a critical current density, at which the supply of metal ions to the surface of the substrate W reaches a critical limit. When an electric current that exceeds the critical current density flows on the surface of the substrate W, a defect (e.g. plating discoloration) can be produced in the surface of the substrate W, or abnormal deposition of a plating metal, which is to be filled into the patterned holes of the substrate W, can occur. A paddle having higher agitating performance (higher agitating power) can supply a larger amount of metal ions to the substrate W and allows for a higher critical current density.

As shown in FIG. 29, the use of any of the agitation rods 22 according to the above-described embodiments can increase the current density as compared to the use of the comparative agitation rod. Thus, as can be seen from the experimental results of FIG. 29, the agitating performance of any of the agitation rods 22 according to the embodiments is superior to the agitating performance of the comparative agitation rod. In particular, the experimental data have shown that when the plating solution is agitated by using the agitation rods 22 having the shape of FIG. 28A or the agitation rods 22 having the shape of FIG. 8, the substrate W can be plated properly even when the current density on the surface of the substrate W is increased to 127%.

FIGS. 30A and 30B are diagrams showing results of an experiment which was conducted to determine the agitating performance of the agitation rod 22 having the shape of FIG. 28A for which good results were obtained in the experiment of FIG. 29. FIGS. 31A and 31B are diagrams showing results of an experiment which was conducted to determine the agitating performance of the agitation rod 22 having the shape of FIG. 8 for which good results were obtained in the experiment of FIG. 29. FIGS. 30A and 31A show results of plating of a substrate W in which a bump pattern of holes, each having an aspect ratio (depth/diameter ratio) of 4:1, is formed in a photoresist layer on a seed layer, while a current density on the substrate W was measured. FIGS. 30B and 31B show results of plating of the substrate W, performed at varying reciprocating speeds of the paddle 16.

As can be seen from the data in FIG. 30A, the current density can be increased to 100% in any of the cases where the ratio (R1/a2) of the radius of curvature R1 (see FIG. 16) of the slope surface 51 to the distance a2 (see FIG. 16) between the side ends 50*a*, 50*b* of the planar portion 50 is 0.667, 0.833 and 1.000.

As can be seen from FIG. 30B, the reciprocating speed of the paddle 16 can be decreased to 80% in the case where the ratio (R1/a2) is 0.833, and can be decreased to 66.7% in the case where the ratio (R1/a2) is 1.000.

As can be seen from FIG. 31A, the current density can be increased to 100% in the cases where the ratio (b1/a1) of the distance b1 (see FIG. 8) between the planar portion 40 and the tip portion 42 to the distance a1 (see FIG. 8) between the side ends 40*a*, 40*b* of the planar portion 40 is 0.500 and 0.667. Especially when the ratio (b1/a1) is 0.500, the current density can be increased to 112.5%.

As can be seen from FIG. 31B, the reciprocating speed of the paddle 16 can be decreased to 80.0% both in the case where the ratio (b1/a1) is 0.667 and in the where the ratio (b1/a1) is 0.500.

FIG. 30B and the data of FIG. 31B show that by optimizing the shape of the agitation rod 22, the substrate W can be plated properly even when the reciprocating speed of the paddle 16 is low. Therefore, according to the embodiments, it becomes possible to prevent scattering of the plating solution in the plating tank 1 and to reduce the load on the paddle driving device 29 for reciprocating the paddle 16.

The plating apparatus according to the above-described embodiments uses the substrate holder which is to be immersed in a plating solution while holding a substrate in a vertical position in the plating tank; however, the plating apparatus is not limited to such embodiments. For example, it is possible to use a plating apparatus which uses a substrate holder (cup-type substrate holder) that holds a substrate in a horizontal position in a plating tank. A paddle having any of the shapes according to the above-described embodiments may be provided in such a plating tank. During plating of a substrate, while reciprocating the paddle, a flow of a plating solution may be created which allows the plating solution to pass through the openings formed by the agitation rods of the paddle (i.e. the spaces between the agitation rods) and impinge on the plating surface of the substrate, and then allows the plating solution to flow in a horizontal direction. In this case, the paddle may be a disk-shaped member.

While the present invention has been described with reference to the various embodiments, it is understood that the present invention is not limited to the embodiments described above, and is capable of various changes and modifications within the scope of the technical concept as expressed herein.

What is claimed is:

1. A paddle for agitating a plating solution by reciprocating parallel to a surface of a substrate, comprising:

a plurality of vertically-extending agitation rods, wherein each of the agitation rods includes:

a planar portion perpendicular to a reciprocating direction of the paddle, the planar portion forming a swirling flow of the plating solution that pulls the plating solution that has come into contact with the substrate back toward the paddle;

two slope surfaces extending from side ends of the planar portion in directions closer to each other, the two slope surfaces being symmetric with respect to a center line of the agitation rod, the center line being perpendicular to the planar portion, the two slope surfaces forming a flow that pushes the plating solution toward the surface of the substrate; and a tip portion connected with the two slope surfaces, the tip portion facing in the reciprocating direction of the paddle, wherein the agitation rods comprise first agitation rods facing in the same one direction and second agitation rods facing in the opposite direction, and wherein the first agitation rods and the second agitation rods are arranged alternately.

2. The paddle according to claim 1, wherein:

the first agitation rods are disposed at one side of a center line of the paddle;

the second agitation rods are disposed at the opposite side of the center line of the paddle; and the first agitation rods and the second agitation rods face toward an outer side of the paddle.

3. The paddle according to claim 1, wherein:

the first agitation rods are disposed at one side of a center line of the paddle;

the second agitation rods are disposed at the opposite side of the center line of the paddle; and the first agitation rods and the second agitation rods face toward the center line of the paddle.

4. A paddle for agitating a plating solution by reciprocating parallel to a surface of a substrate, comprising:

a plurality of vertically-extending agitation rods, wherein each of the agitation rods includes:

a planar portion perpendicular to a reciprocating direction of the paddle, the planar portion forming a swirling flow of the plating solution that pulls the plating solution that has come into contact with the substrate back toward the paddle;

two slope surfaces extending from side ends of the planar portion in directions closer to each other, the two slope surfaces forming a flow that pushes the plating solution toward the surface of the substrate; and a tip portion connected with the two slope surfaces, the tip portion facing in the reciprocating direction of the paddle, wherein the agitation rods comprise first agitation rods and second agitation rods which face in opposite directions and are arranged alternately, and wherein a distance between planar portions of a first agitation rod and an adjacent second agitation rod, facing away from each other, of the agitation rods is larger than a distance between tip portions of a first agitation rod and an adjacent second agitation rod, facing each other, of the agitation rods.

5. A paddle for agitating a plating solution by reciprocating parallel to a surface of a substrate, comprising:

a plurality of vertically-extending agitation rods, wherein each of the agitation rods includes:

a planar portion perpendicular to a reciprocating direction of the paddle;

two slope surfaces extending from side ends of the planar portion in directions closer to each other; and a tip portion connected with the two slope surfaces, wherein the agitation rods comprise first agitation rods and second agitation rods which face in opposite directions and are arranged alternately, and wherein a distance between planar portions of a first agitation rod and an adjacent second agitation rod, facing away from each other, of the agitation rods is larger than a distance between tip portions of a first agitation rod and an adjacent second agitation rod, facing each other, of the agitation rods, and wherein a volume of a first flow passage formed between the first agitation rod and the adjacent second agitation rod facing away from each other is equal to a volume of a second flow passage formed between the first agitation rod and the adjacent second agitation rod facing each other.

6. A plating apparatus comprising:

a plating tank for holding a plating solution;

an anode disposed in the plating tank;

a substrate holder for holding a substrate and disposing the substrate in the plating tank; and the paddle according to claim 1 disposed between the anode and the substrate for agitating the plating solution by reciprocating parallel to a surface of the substrate.

7. A plating method comprising:

disposing an anode and a substrate opposite each other in a plating solution held in a plating tank; and reciprocating the paddle according to claim 1, disposed between the anode and the substrate, parallel to the substrate while applying a voltage between the anode and the substrate.

* * * * *